US012492030B2

(12) United States Patent
Mason et al.

(10) Patent No.: US 12,492,030 B2
(45) Date of Patent: Dec. 9, 2025

(54) TURRET ASSEMBLIES FOR CONTAINER SEALING SYSTEM

(71) Applicant: JBT Marel Corporation, Chicago, IL (US)

(72) Inventors: Kristen Rose Mason, Mentor, OH (US); Chane Lee, Sarasota, FL (US)

(73) Assignee: JBT Marel Corporation, Chicago, IL (US)

( * ) Notice: Subject to any disclaimer, the term of this patent is extended or adjusted under 35 U.S.C. 154(b) by 0 days.

(21) Appl. No.: 18/491,420

(22) Filed: Oct. 20, 2023

(65) Prior Publication Data

US 2024/0132241 A1 Apr. 25, 2024
US 2024/0228092 A9 Jul. 11, 2024

Related U.S. Application Data

(60) Provisional application No. 63/380,582, filed on Oct. 23, 2022.

(51) Int. Cl.
*B65B 43/50* (2006.01)

(52) U.S. Cl.
CPC ..... *B65B 43/50* (2013.01)

(58) Field of Classification Search
USPC ..... 53/79
See application file for complete search history.

(56) References Cited

U.S. PATENT DOCUMENTS 2,052,620 A 9/1936 Guenther
2,692,715 A * 10/1954 Doudera, Jr. ..... B65B 31/00 141/70
3,545,160 A 12/1970 Jantze et al.
10,065,756 B2 9/2018 Washikazi et al.
10,941,029 B2 3/2021 Yuse et al.
2013/0078116 A1* 3/2013 Washizaki ..... B67C 3/222 417/54
2014/0321949 A1 10/2014 Mejia-Quinchia et al.
2023/0053801 A1* 2/2023 Derendinger ..... B65B 31/043

OTHER PUBLICATIONS

American Holt, "Angelus 120L/121L Seamer," internal brochure regarding aftermarket parts, Jul. 16, 2019, 65 pages.
Pneumatic Scale Angelus, "Angelus Legacy Series Can Seamer: Model 121L," brochure, 2 pages. As early as Oct. 22, 2022.
Pneumatic Scale Angelus, "Model 121L Seamer, Serial No. 121L-13418: Operation, Maintenance and Parts Manual," Apr. 2012, 208 pages.

* cited by examiner

*Primary Examiner* — Chinyere J Rushing-Tucker
(74) *Attorney, Agent, or Firm* — Christensen O'Connor Johnson Kindness PLLC

(57) ABSTRACT

A turret assembly rotatably mountable to a container sealing system. The turret assembly includes an annular turret having a plurality of arcuate container pockets arrayed about an outer periphery of the turret and an annular chamber located radially inward of the outer periphery of the turret, and a hub removably secured within the annular chamber of the turret, wherein the hub is adapted to be rotatably secured to the container sealing system. A turret system for use with a can seamer is also provided, and includes two or more annular turrets, and a hub removably securable within the annular chamber of the two or more annular turrets for selectively mounting the annular turrets to the hub and the can seamer.

20 Claims, 29 Drawing Sheets

TURRET ASSEMBLIES FOR CONTAINER SEALING SYSTEM

CROSS-REFERENCE TO RELATED APPLICATION

This application claims the benefit of U.S. Provisional Application No. 63/380,582, filed Oct. 23, 2022, the entire contents of which are incorporated herein by reference.

BACKGROUND

Canned beverages are packaged in a wide variety of can sizes and shapes, and many packaging plants fill multiple sizes of cans from one day to the next, or even within a single day. Each can size change necessitates stopping packaging while various guide rails, rotating turrets, and other assemblies of the can seaming line are either adjusted for the new can size/shape or replaced with the appropriately sized and configured components. This is a time-consuming process that limits production. In the case of rotating turrets, for example, replacing a turret to accommodate a different can size/shape requires proper adjustment of the timing of the new turret with respect to the can seamer mechanism before production can resume.

While a variety of devices and techniques may exist for changing turrets and other components of container seaming systems, it is believed that no one prior to the inventor(s) has made or used an invention as described herein.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a turret assembly is provided that is rotatably mountable to a container sealing system. The turret assembly may include: (a) an annular turret having a plurality of arcuate container pockets arrayed about an outer periphery of the turret and an annular chamber located radially inward of the outer periphery; and (b) a hub removably secured within the annular chamber of the turret; wherein the hub is adapted to be rotatably secured to the container sealing system.

In any of the embodiments described herein, said hub includes an annular lower hub portion alignably secured to an annular upper hub portion.

In any of the embodiments described herein, said annular lower hub portion is removably secured to said annular upper hub portion, and further comprising a plurality of alignment pins extending between said lower and upper hub portions, said alignment pins adapted for guiding the aligned securement of the lower and upper hub portions.

In any of the embodiments described herein, the turret includes upper and lower turret members, the upper turret member comprising a plurality of upper arcuate container pocket portions, the lower turret member comprising a plurality of lower arcuate container pocket portions, and wherein the upper and lower turret members are alignably secured to one another such that each of the upper arcuate container pocket portions is aligned with one of the lower arcuate container pocket portions to thereby form said plurality of arcuate container pockets arrayed about the outer periphery of the turret.

In any of the embodiments described herein, the lower turret member includes a feed turret body and the upper turret member includes a feed turret cover plate secured to said feed turret body.

In any of the embodiments described herein, the annular chamber of the turret includes an inner annular wall of the feed turret body located radially inward of an outer periphery of the feed turret body, and an annular flange extending radially inward from a lower portion of the inner annular wall of the feed turret body.

In any of the embodiments described herein, said annular flange includes a plurality of apertures and said hub includes a plurality of apertures alignable with the apertures in said annular flange, and wherein a plurality of fasteners are configured to extend through corresponding apertures in said annular flange and an aligned one of the apertures in said hub.

In any of the embodiments described herein, the lower turret member includes a lower discharge turret plate and the upper turret member includes an upper discharge turret plate secured to said lower discharge turret plate in a spaced-apart relationship.

In any of the embodiments described herein, the lower discharge turret plate has a bottom surface, and said annular chamber includes an annular recess in said bottom surface.

In any of the embodiments described herein, at least one of the annular turret and the hub is bifurcated into first and second halves such that a radially extending juncture is provided between the first and second halves.

In any of the embodiments described herein, both the annular turret and the hub are bifurcated into first and second halves.

In any of the embodiments described herein, the annular turret is a feed turret adapted for discharging a gas from orifices arranged in the arcuate container pockets.

In any of the embodiments described herein, the annular turret includes a plurality of gas flow chambers extending between the annular chamber and the orifices.

In any of the embodiments described herein, the hub includes a plurality of gas flow chambers adapted to receive gas from the container sealing system and direct the gas into the gas flow chambers of the annular turret.

In any of the embodiments described herein, the hub includes an upper surface having a plurality of gas inlets therein, and an outer peripheral side having a plurality of gas outlets therein, wherein each of the gas flow chambers of the hub extends between one of said gas inlets in the upper surface of the hub and one of said gas outlets in the outer peripheral side of the hub.

In any of the embodiments described herein, the annular chamber of the turret includes an inner annular wall located radially inward of the outer periphery of the turret, said inner annular wall having a plurality of gas inlets, wherein each of the gas flow chambers of the annular turret extends between one of the gas inlets in the inner annular wall of the turret and at least one orifice in one of said arcuate container pockets.

In any of the embodiments described herein, the hub is removably secured within the annular chamber of the annular turret such that each of the gas outlets of the hub is aligned with one of the gas inlets of the annular turret, whereby each of the gas flow chambers of the annular turret is in fluid communication with one of the gas flow chambers of the hub.

In any of the embodiments described herein, the annular turret includes an annular feed turret body and an annular feed turret cover plate secured to the feed turret body.

In any of the embodiments described herein, the turret includes an inner annular wall located radially inward of the outer periphery of the annular turret, said inner annular wall having a plurality of gas inlets, wherein each of the gas flow chambers of the annular turret extends between one of the gas inlets in the inner annular wall of the annular turret and at least one orifice in one of said arcuate container pockets.

In any of the embodiments described herein, the feed turret body includes a plurality of lower channels, wherein each of the gas flow chambers of the annular turret includes one of said lower channels in the feed turret body.

In any of the embodiments described herein, the cover plate includes a plurality of upper channels, with each of the gas flow chambers of the annular turret includes one of said lower channels in the feed turret body and an adjacent upper channel of the cover plate.

In any of the embodiments described herein, each of said lower channels extends radially between the inner annular wall of the feed turret body and an upwardly sloped endwall spaced radially inward of the outer periphery of the feed turret body, wherein the sloped endwall is increases the velocity of the gas prior to discharge from said orifices.

In any of the embodiments described herein, the annular turret includes a plurality of orifices arranged in each of said arcuate container pockets.

In any of the embodiments described herein, said cover plate includes a plurality of fins extending downwardly from a bottom surface of said cover plate, wherein said orifices are defined by adjacent pairs of said fins.

In accordance with another embodiment of the present disclosure, a turret system for use with a container sealing system is provided. The turret system may include: two or more annular turrets, each annular turret comprising: a plurality of arcuate container pockets arrayed about an outer periphery of the annular turret; and an annular chamber located radially inward of the outer periphery; and a hub removably securable within the annular chamber of each of the two or more annular turrets for selectively mounting each of said annular turrets to the hub; wherein the hub is adapted to be rotatably secured to the container sealing system and is securable within the annular chamber of each of the two or more annular turrets while the hub is secured to the container sealing system such that one of said annular turrets can be replaced by another one of said annular turrets without removing the hub from the can seamer.

In accordance with another embodiment of the present disclosure, a first turret assembly for a container sealing system is provided. The first turret assembly may include: a hub adjustably and rotatably securable to the container sealing system such that the timing of the first turret assembly may be adjusted relative to a second turret assembly of the container sealing system; an annular turret body having a plurality of arcuate container pockets arrayed about an outer periphery of the annular turret body, the annular turret body removably securable to the hub; and an alignment assembly configured to align the annular turret body on the hub such that the first turret assembly remains timed relative to the second turret assembly when the annular turret body is received on the hub.

In any of the embodiments described herein, the annular turret body includes a first turret body portion and a second turret body portion.

In any of the embodiments described herein, a gas purge assembly is configured to direct purge gas across a headspace between a container end and a surface of a product within a container located in one of the plurality of arcuate container pockets in order to purge air from the container immediately prior to sealing, wherein the gas purge assembly is configured to create a laminar flow of purge gas through the hub and the annular turret body.

In any of the embodiments described herein, a gas purge assembly is configured to direct purge gas across a headspace between a container end and a surface of a product within a container located in one of the plurality of arcuate container pockets in order to purge air from the container immediately prior to sealing, wherein the gas purge assembly is configured to direct purge gas upwardly as it flows radially through the hub and the annular turret body toward an orifice assembly in the arcuate container pocket.

In any of the embodiments described herein, a gas purge assembly is configured to direct purge gas across a headspace between a container end and a surface of a product within a container located in one of the plurality of arcuate container pockets in order to purge air from the container immediately prior to sealing, wherein the gas purge assembly is configured to decrease the velocity of purge gas as it exits an orifice assembly in the arcuate container pocket.

In any of the embodiments described herein, a gas purge assembly includes: a plurality of gas purge inlets defined in the hub that are configured to receive purge gas from a purge gas supply; a plurality of hub gas flow chambers defined in the hub, each in fluid communication with a corresponding gas purge inlet; a plurality of turret gas flow chambers defined in the annual turret body, each in fluid communication with a corresponding hub flow chamber; and a plurality of purge gas orifices defined in each of the arcuate container pockets of the annular turret body, wherein each of the plurality of purge gas orifices is in fluid communication with a corresponding hub gas flow chamber.

In any of the embodiments described herein, a cross-sectional area of each turret gas flow chamber increases as the purge gas flows radially outward through the turret gas flow chamber.

In any of the embodiments described herein, the plurality of purge gas orifices are defined by a plurality of fins extending downwardly from and integrally formed on an underside of a cover plate secured to the annual turret body.

In any of the embodiments described herein, the plurality of purge gas orifices are defined by a plurality of fins extending radially from an arcuate outer peripheral edge of each of the arcuate container pockets toward the corresponding turret gas flow chamber.

In any of the embodiments described herein, a distance between adjacent fins decreases towards an outer peripheral edge of the arcuate container pocket.

In any of the embodiments described herein, a radial length of each fin decreases from a central location of the arcuate container pocket towards an outer peripheral edge of the arcuate container pocket.

In accordance with another embodiment of the present disclosure, a purge gas assembly for a turret assembly of a container sealing system is provided. The purge gas assembly is configured to direct purge gas across a headspace between a container end and a surface of a product within a container located in one of a plurality of arcuate container pockets of a turret in order to purge air from the container immediately prior to sealing, the purge gas assembly comprising: a plurality of gas purge inlets configured to receive purge gas from a purge gas supply; a plurality of gas flow chambers defined in the turret, each in fluid communication with a corresponding gas purge inlet; and an orifice assembly defined in each of the arcuate container pockets of the turret, wherein the orifice assembly is in fluid communication with a corresponding hub gas flow chamber; wherein the gas purge assembly is configured to create a laminar flow of purge gas through the turret.

In any of the embodiments described herein, the gas purge assembly is configured to direct purge gas upwardly as it flows radially through the turret toward the orifice assembly in the arcuate container pocket.

In any of the embodiments described herein, the gas purge assembly is configured to decrease the velocity of purge gas as it exits the orifice assembly.

In any of the embodiments described herein, a cross-sectional area of each gas flow chamber increases as the purge gas flows radially outward through the gas flow chamber.

In any of the embodiments described herein, each orifice assembly includes a plurality of purge gas orifices defined by a plurality of fins extending downwardly from and integrally formed on an underside of a cover plate secured to the turret.

In any of the embodiments described herein, each orifice assembly includes a plurality of fins extending radially from an arcuate outer peripheral edge of the arcuate container pocket toward the gas flow chamber.

In any of the embodiments described herein, a distance between adjacent fins decreases towards an outer peripheral edge of the arcuate container pocket.

In any of the embodiments described herein, a radial length of each fin decreases from a central location of the arcuate container pocket towards an outer peripheral edge of the arcuate container pocket.

In accordance with another embodiment of the present disclosure, a turret system for a container sealing system is provided. The turret system includes: a first turret assembly; a second turret assembly, comprising: a hub adjustably securable to the container sealing system such that the timing of the second turret assembly may be adjusted relative to the first turret assembly; a first annular turret body having a plurality of arcuate container pockets arrayed about an outer periphery of the second annular turret body, the first annular turret body removably securable to the hub; a second annular turret body having a plurality of arcuate container pockets arrayed about an outer periphery of the second annular turret body, the second annular turret body removably securable to the hub; an alignment assembly configured to align the first annular turret body on the hub for use with a first container and configured to align the second annular turret body on the hub for use with a second container, wherein the first turret assembly remains timed relative to the second turret assembly when either of the first and second annular turret bodies is received on the hub.

In any of the embodiments described herein, the hub is secured to the container sealing system such that one of said annular turret bodies can be replaced by another one of said annular turret bodies without removing the hub from the can seamer.

In any of the embodiments described herein, the second turret assembly includes any of the aspects of the first turret assembly described herein.

In any of the embodiments described herein, a purge gas assembly as described herein is included.

BRIEF DESCRIPTION OF THE DRAWINGS

While the specification concludes with claims particularly pointing out and distinctly claiming the invention, it is believed that the invention will be better understood from the detailed description of certain embodiments thereof when read in conjunction with the accompanying drawings. Unless the context indicates otherwise, like numerals are used in the drawings to identify similar elements in the drawings. In addition, some of the figures may have been simplified by the omission of certain elements in order to more clearly show other elements. Such omissions are not necessarily indicative of the presence or absence of particular elements in any of the exemplary embodiments, except as may be explicitly stated in the corresponding detailed description.

Figure 1:
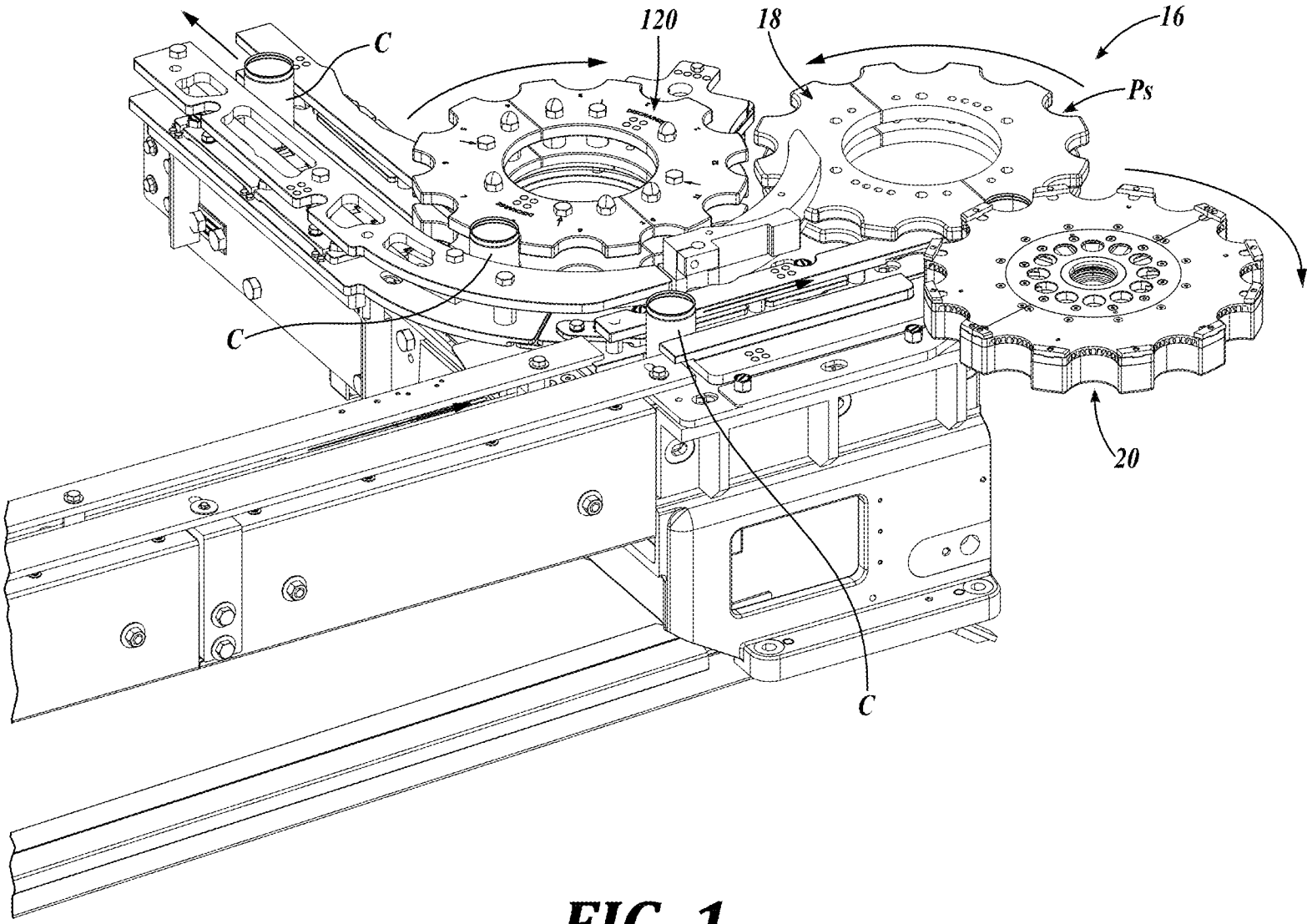
FIG. 1 is a schematic view of a segment of a can seaming line wherein portions of the can seamer have been omitted for clarity.

The drawings are intended to illustrate rather than limit the scope of the present invention. Embodiments of the present invention may be carried out in ways not necessarily depicted in the drawings. Thus, the drawings are intended to merely aid in the explanation of the invention. Thus, the present invention is not limited to the precise arrangements shown in the drawings.

DETAILED DESCRIPTION

The following detailed description describes examples of embodiments of the invention solely for the purpose of enabling one of ordinary skill in the relevant art to make and use the invention. As such, the detailed description and illustration of these embodiments are purely illustrative in nature and are in no way intended to limit the scope of the invention, or its protection, in any manner. It should also be understood that the drawings are not to scale and in certain instances details have been omitted, which are not necessary for an understanding of the present invention.

Container sealing systems, such as can seamers, typically include one or more turrets for controlling movement of cans through the seaming process. In that regard, turret assemblies are rotatable components that can receive, transport, and deliver containers within various portions of a container sealing system. As noted above, replacing a turret to accommodate a different can size/shape requires proper adjustment of the timing of the new turret with respect to the can seamer mechanism before production can resume.

Embodiments of the present disclosure relate to improved turret assemblies and systems for use, e.g., in a container sealing system (e.g., a can seamer). The turret assemblies and systems disclosed herein facilitate easier changeovers and improved performance as compared to conventional (e.g., OEM) components.

In accordance with examples provided herein, a turret assembly configured to be rotatably mounted within a container sealing system can include an annular turret having a plurality of arcuate container pockets arrayed about an outer periphery of the turret, and an annular chamber located radially inward of the outer periphery. The turret assembly further can include a hub removably securable within the annular chamber of the annular turret, wherein the hub is adapted to be rotatably secured to the container sealing system. In one particular embodiment, the turret assembly is a feed turret assembly for a can seamer (e.g., an Angelus Model 120L or 121L can seamer). In another embodiment, the turret assembly is a discharge turret assembly for a can seamer (e.g., an Angelus Model 120L or 121L can seamer).

The hub generally can include an annular lower hub portion (or base plate) alignably secured to an annular upper hub portion (or base plate). The lower hub portion is removably secured to the annular upper hub portion (e.g., using threaded fasteners). In some embodiments, a plurality of alignment pins extending between the lower and upper hub portions are provided in order to guide the aligned securement of the lower and upper hub portions.

The turret assembly generally can include upper and lower turret members. When the turret assembly is a feed turret assembly for a can seamer, the lower turret member can include a feed turret body, and the upper turret member can include a cover plate. When the turret assembly is a discharge turret assembly for a can seamer, the lower turret member can include a lower discharge turret plate, and the upper turret member can include an upper discharge turret plate. In some embodiments, each of the upper and lower turret members can include a plurality of arcuate container pocket portions, such that when the upper and lower turret members are alignably secured to one another each of the upper arcuate container pocket portions is aligned with one of the lower arcuate container pocket portions to thereby form a plurality of arcuate container pockets arrayed about the outer periphery of the turret.

The annular chamber can comprise an inner annular wall of the annular turret (e.g., of a feed turret body) located radially inward of an outer periphery of the turret, and an annular flange extending radially inward from a lower portion of the inner annular wall of the turret. The flange can include a plurality of apertures (e.g., through holes or blind holes) and the hub can include a plurality of apertures (e.g., through holes or blind holes) alignable with the apertures in the annular flange. Fasteners (e.g., thread fasteners such as bolts) can be used to secure the hub within the annular chamber.

Alternatively, when the turret assembly is a discharge turret assembly having a lower discharge turret plate secured to an upper discharge turret plate (optionally, in a spaced relationship), the annular chamber can comprise an annular recess in the bottom (underside) of the lower discharge turret plate.

In some instances, at least one of the annular turret and the hub is bifurcated into first and second halves, such that a radially extending juncture is provided between the first and second halves (when the turret assembly is assembled). In some embodiments, both the annular turret and the hub are bifurcated into first and second halves (or trifurcated, etc.).

In the instance of a turret assembly comprising a feed turret assembly rotatably mountable to a can seamer, the turret (a feed turret) is adapted for discharging a gas (e.g., a purge gas) from orifices arranged in the arcuate container pockets. The annular feed turret can include a plurality of gas flow chambers extending between the annular chamber of the turret and the orifices. The hub (e.g., a center hub) similarly can include a plurality of gas flow chambers adapted to receive gas from the can seamer and direct the gas into the gas flow chambers of the feed turret.

In some embodiments, the hub can include an upper surface having a plurality of gas inlets therein, and an outer peripheral side having a plurality of gas outlets therein, wherein each of the gas flow chambers of the hub extends between one of the gas inlets in the upper surface of the hub and one of the gas outlets in the outer peripheral side of the hub. The annular chamber of the feed turret includes an inner annular wall located radially inward of the outer periphery of the feed turret. The inner annular wall of the feed turret includes a plurality of gas inlets, wherein each of the gas flow chambers of the feed turret extends between one of the gas inlets in the inner annular wall of the feed turret and at least one orifice in one of the arcuate container pockets. The hub is removably securable within the annular chamber of the feed turret such that each of the gas outlets of the hub is aligned with one of the gas inlets of the feed turret, whereby each of the gas flow chambers of the annular turret is in fluid communication with one of the gas flow chambers of the hub.

As mentioned above, when the turret assembly is a feed turret assembly for a can seamer, the lower turret member can include a feed turret body, and the upper turret member can include a cover plate. In some instances, the feed turret body includes a plurality of lower channels, wherein each of the gas flow chambers of the turret can include one of said lower channels in the feed turret body. The cover plate in these instances can include a plurality of upper channels, with each of the gas flow chambers of the turret comprising one of the lower channels in the feed turret body and an adjacent upper channel of the cover plate. Each of the lower channels extends radially between the inner annular wall of the feed turret body and an upwardly sloped endwall spaced radially inward of the outer periphery of the feed turret body. This sloped endwall redirects the purge gas upward towards the upper gas flow channels, while maintaining a low velocity with generally laminar flow in order to displace any air (i.e., oxygen) and avoid creating a Venturi effect that pulls in air. In still further embodiments, the feed turret can include a plurality of orifices arranged in each of the arcuate container pockets. The cover plate can include a plurality of fins extending downwardly from a bottom surface of the cover plate, wherein the orifices are defined by adjacent pairs of fins.

In accordance with examples provided herein, a turret system for use with a can seamer (or other container sealing system) can include two or more annular turrets, each annular turret having a plurality of arcuate container pockets arrayed about an outer periphery of the turret, and an annular chamber located radially inward of the outer periphery. The system can further include a hub removably securable within the annular chamber of the two or more annular turrets for selectively mounting the annular turrets to the hub. The hub may be rotatably secured to the can seamer, and the hub may be securable within the annular chamber of the two or more annular turrets while the hub is secured to the container sealing system. This allows for one turret to be replaced by another (e.g., to accommodate different sizes and/or shapes of cans, to replace a damaged turret, or remove a turret for cleaning), without removing the hub from the can seamer.

As used herein, the term "hole" may encompass apertures, slots, and other passageways for receiving a fastener. Unless otherwise indicated or required, a blind hole can be used in place of a through hole, and a through hole can be used in place of a blind hole. Similarly, any of a variety of fasteners can be used for attaching the various components described herein, including threaded fasteners (e.g., threaded bolts). In addition, when a threaded fastener is passed through holes on two components for fastening purposes, unless otherwise indicated or required, either or both of the holes used to receive a fastener can be threaded. Alternatively, or in addition thereto, unless otherwise indicated or required, separate threaded nuts and/or threaded inserts can be used to secure a threaded fastener within holes on two components affixed to one another. It will also be understood that, unless otherwise indicated or required, components described herein can be affixed to one another in a variety of alternative ways (or in addition to threaded fasteners), such as by welding (unless the context requires that two components are removably affixed to one another).

FIG. 1 depicts a schematic view of a portion of a container sealing line (16) for sealing container ends (e.g., lids) to containers (e.g., cans) filled with product (e.g., a beverage or other liquid). In the particular embodiment shown, the container sealing line is a container seaming line wherein filled containers are sealed by seaming a container end to an open end of a filled container. The container seaming line (16) is located downstream of a product filler (not shown) such that it may be used to seam container ends to the open end of the containers (C) after the containers have been filled with product. Filled containers, in this example cans (C), are transported at high speed along a moving chain conveyor, in the directions shown in FIG. 1, with various guide rails directing the cans to a seamer. The seamer includes a rotating seamer turret (18), a rotating feed turret assembly (20), and a rotating discharge turret assembly (120). Other components of the seamer have been omitted for clarity (e.g., the seamer housing, motors, seaming mechanisms comprising seaming levers, chucks, rolls, and seaming cam, etc.).

In the seamer (a can seamer in the example shown), a container end (e.g., a can lid, not shown) is positioned directly above the open container when the container enters an arcuate pocket (P) of the feed turret assembly (20), adjacent the seamer turret (18). Purge gas (e.g., $CO_2$) is directed across the headspace between the container end and the surface of the product within the container in order to purge air from the container immediately prior to sealing. A mechanism (not shown) above the seamer turret then seals the container end to the container (e.g., by crimping the outer periphery of the container end to the can flange at the open end of the container). The discharge turret assembly (120) then receives the sealed containers from the seamer turret (18) and directs the containers to further processing and/or packaging.

Containers, including beverage cans, are available in a variety of sizes, including a variety of heights and diameters. Additionally, container seaming lines often are not dedicated for use with only one size of container or container end. When it is desired to change a container seaming line (16) to accommodate a different container size, it is necessary to change the seamer turret (18), the feed turret assembly (20), the rotating discharge turret assembly (120), and/or one or more of the guide rails to the appropriate size for the containers. This changeover process is time-consuming, as the components tend to be heavy, awkward to manipulate, and/or difficult to reach on the seamer. Replacement of the feed turret and the discharge turret also typically require adjustment of the turrets for proper timing so that the turrets rotate in synchronized fashion to properly transport and seam containers as they pass through the seamer. The feed turret assembly and discharge turret assembly further described herein facilitate easier changeovers and improved performance as compared to conventional (e.g., OEM) components.

While the embodiments of the present disclosure will be described in connection with a can seamer used to affix lids to the open ends of cans filled with a beverage, it will be understood that the present disclosure is not limited to container seaming lines that seam lids to beverage cans.

Figure 2:
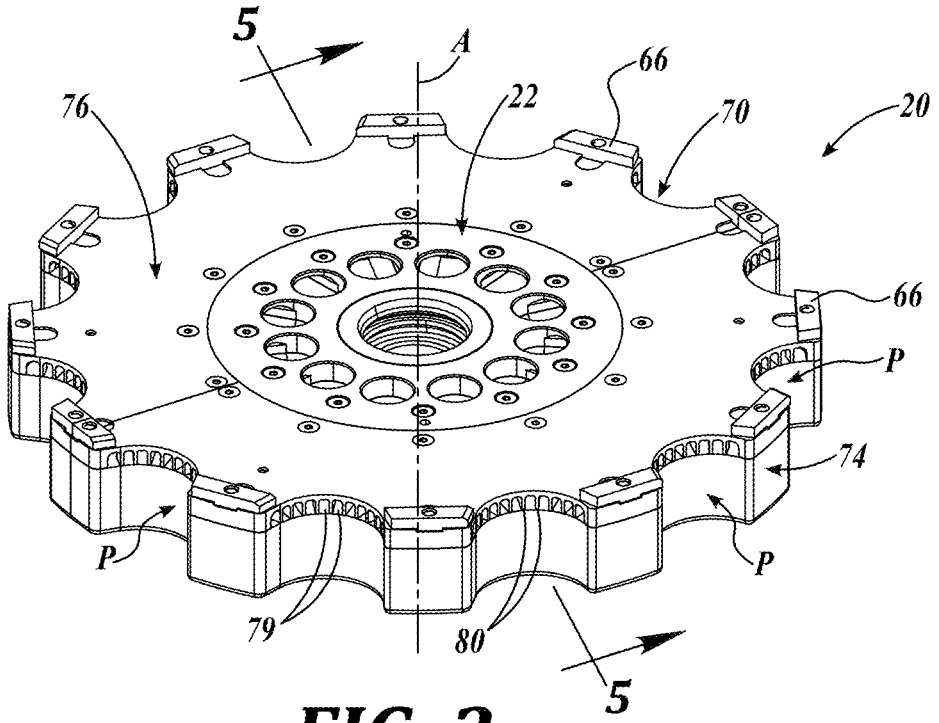
FIG. 2 is an isometric view, from above, of a feed turret assembly according to one embodiment of the present disclosure.
Figure 3:
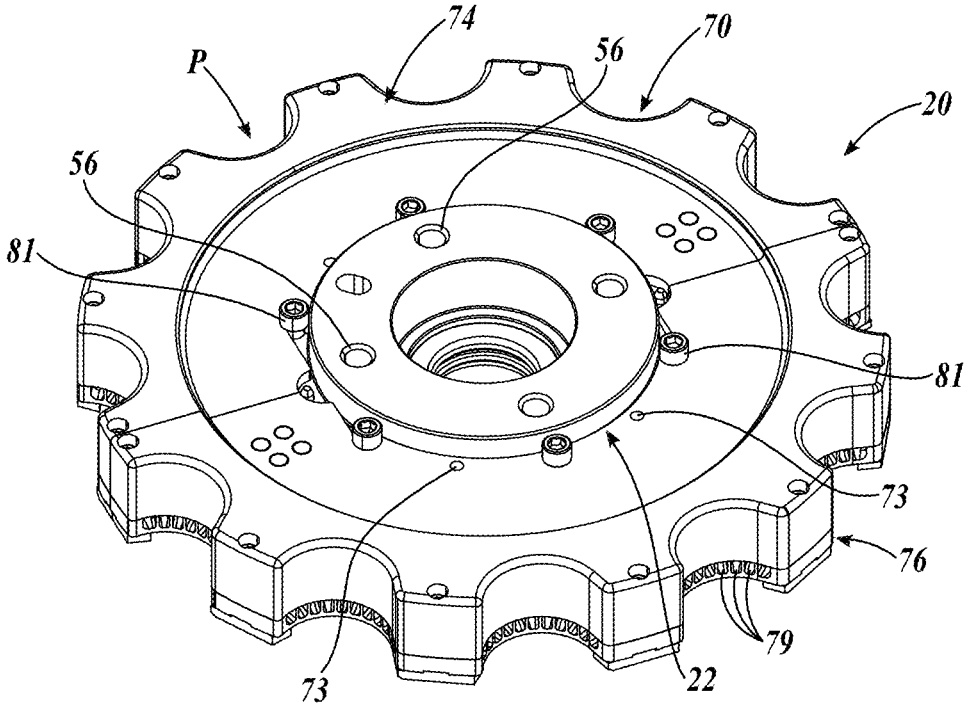
FIG. 3 is an isometric view, from below, of the feed turret assembly of FIG. 2.
Figure 4:
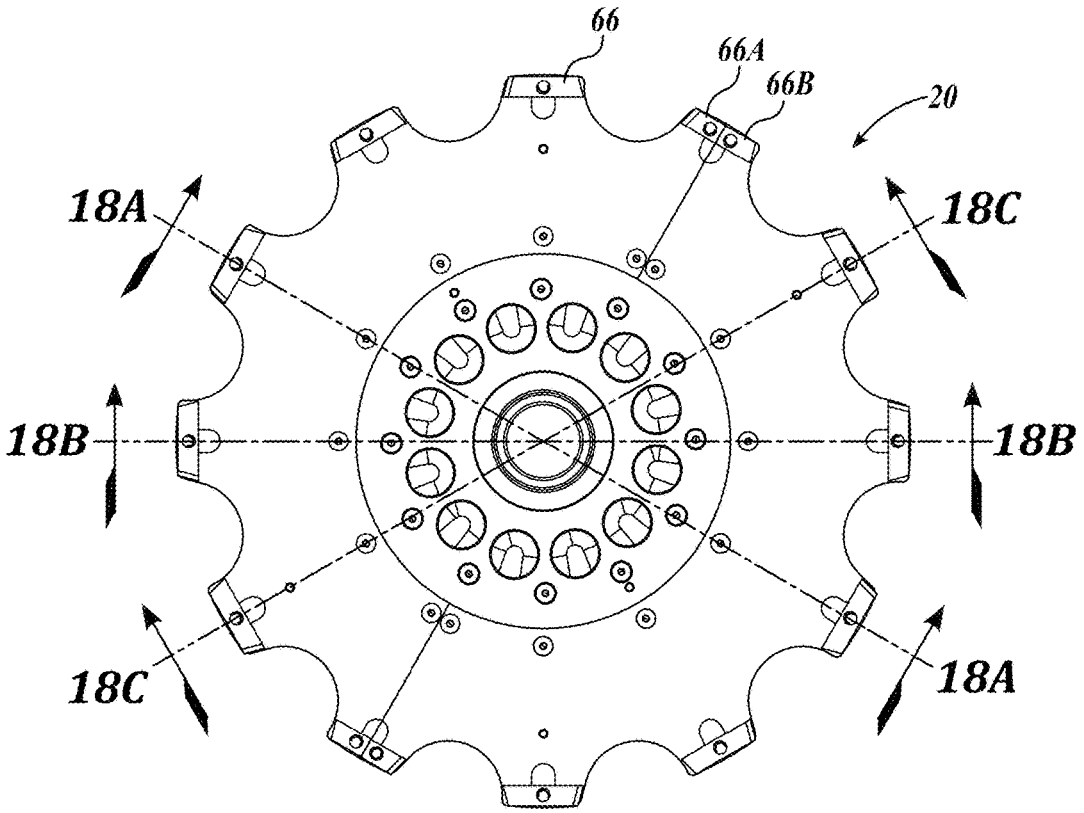
FIG. 4 is a top plan view of the feed turret assembly of FIG. 2.

FIGS. 2 and 3 depict a feed turret assembly (20) according to one embodiment of the present disclosure, viewed from above and below, respectively. The feed turret assembly (20) is adapted to be mounted to a container seamer, such as a can seamer, for rotation about rotational axis (A) of the feed turret assembly. Generally, the feed turret assembly (20) may be used to direct filled cans to the arcuate pockets (Ps) of the seamer turret (12) while also directing purge gas (e.g., $CO_2$) into the headspace between the can end and the surface of the product within the container (for purging before the container is sealed).

Feed turret assembly (20) includes a plurality of arcuate can pockets (P) arrayed about its outer periphery. In the example shown, 12 can pockets (P) are provided. It will be understood, however, that the feed turret assembly can be configured to have any number of can pockets, depending, in part, on the size of the cans being filled. Can pockets (P) of the feed turret assembly are arranged to receive a filled can and transport the filled can to a pocket (Ps, see FIG. 1) of the seamer turret (12) for seaming. Further, as noted above, the feed turret assembly (20) is configured to direct purge gas into the headspace beneath a lid positioned above the open end of the can.

Figure 5:
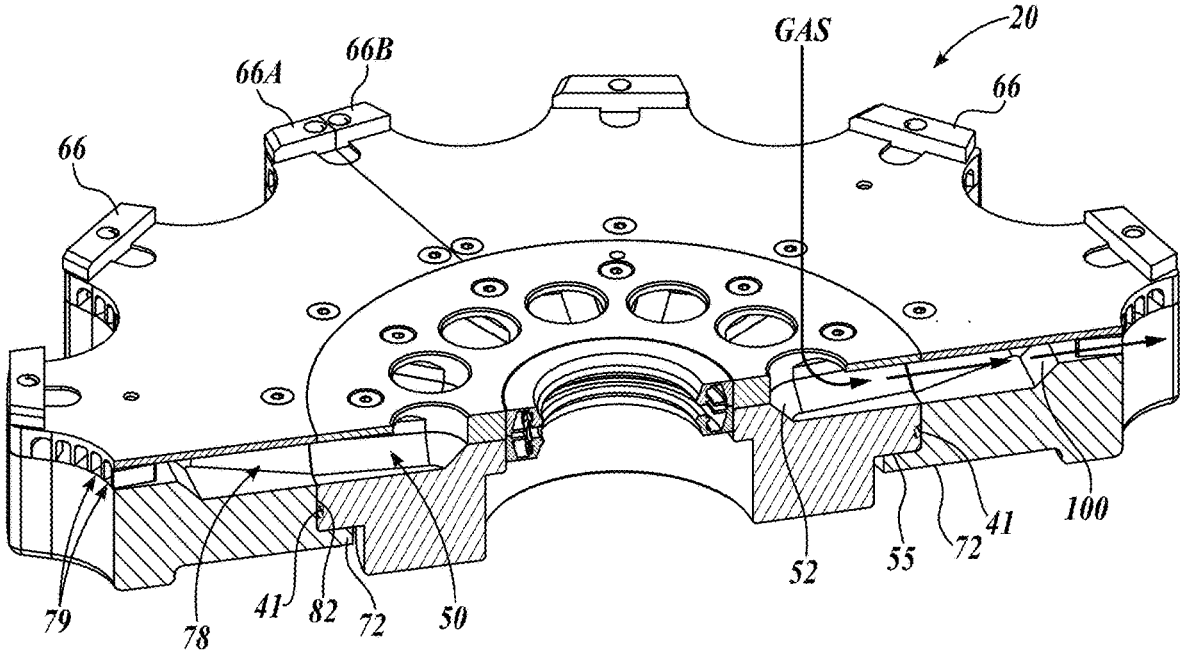
FIG. 5 is a cross-sectional isometric view of the feed turret assembly of FIG. 2, taken along the line 5-5 thereof.
Figure 6:
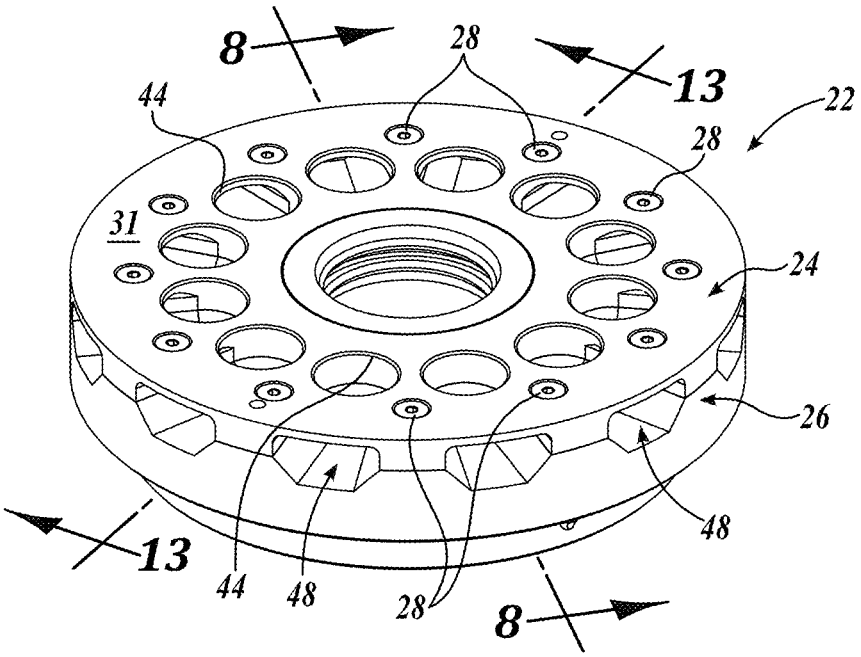
FIG. 6 is an isometric view, from above, of the center hub of the feed turret assembly of FIG. 2.
Figure 15A:
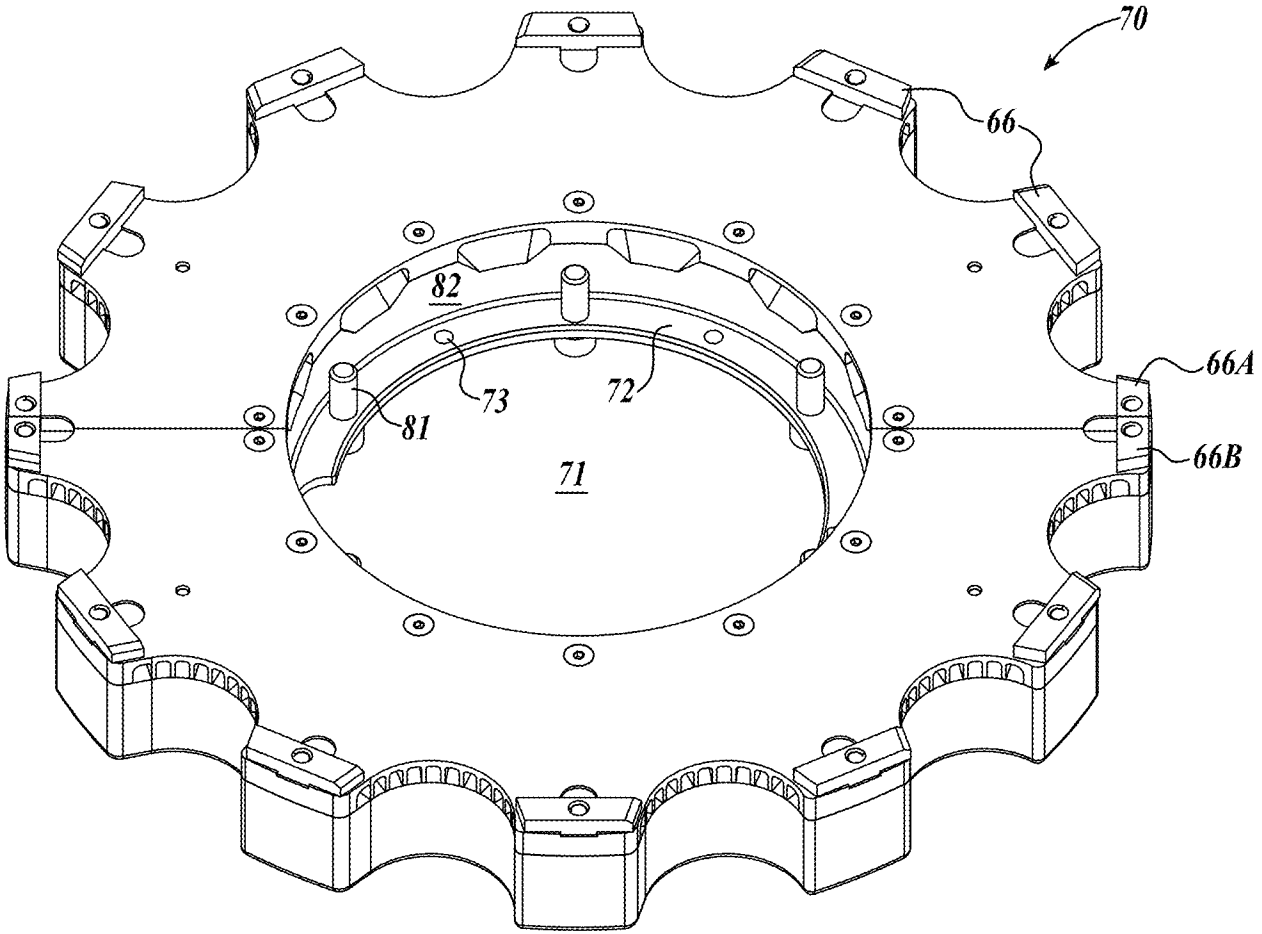
FIG. 15A is an isometric view of the feed turret of FIG. 2, viewed from above, and including the hub mounting bolts but with the center hub omitted.

The feed turret assembly (20) generally includes a center hub (22) (see FIG. 6) and a feed turret (70) (see FIG. 15A). The center hub (22) is adapted to be mounted to the can seamer for driven rotation by the seamer. Both the center hub (22) and the feed turret (70) are annular in shape. The feed turret (70) is mounted over the center hub (22) such that the center hub is received within a flanged annular chamber (71) of the feed turret (70). An annular flange (72) is provided on the feed turret (70), at the base of the annular chamber (71) thereof (see FIG. 15A), with the annular chamber (71) defined by the upper surface of the annular flange (72) and the inner annular wall of the feed turret (70). In the embodiment shown, the inner annular wall of the feed turret comprises the inner annular wall (82) of the feed turret body (74) and the inner annular wall (91) of the cover plate (76B), as further described herein. When the feed turret (70) is mounted to the center hub (22), the bottom surface of a lower shoulder (55) of the center hub (22) abuts against the flange (72) with the outer periphery of the center hub (22) closely fitting within the annular chamber (71) (see FIG. 5).

Looking first at the exemplary center hub (22), and as best seen in FIGS. 6-14, the center hub (22) generally includes an annular upper hub portion (24) mounted to an annular lower hub portion (26). In the example shown, the upper hub portion (24) is mounted to the lower hub portion (26) using a plurality of fasteners in the form of threaded bolts (28). Through-holes (29) are arrayed around the central opening (30) of the upper hub portion, which extend through the thickness of the upper hub portion (24) (from upper surface (31) to lower surface (32); see FIG. 14). The bolts (28) are threadingly received within threaded blind holes (34) in the upper surface (35) of the lower hub portion (26) (see FIG. 13). The blind holes (34) extend orthogonally from the upper surface (35) towards the bottom surface of the lower hub portion (26). It will be understood that the upper and lower hub portions can be affixed to one another in a variety of other ways, or the center hub can be fabricated as a unitary component (or as more than two portions, similar to the configuration of feed turret (70)).

To aid in the assembly and alignment of the center hub, one or more alignment pins (36) may extend between the upper and lower hub portions (24, 26), within apertures therein. In the embodiment shown, two alignment pins (36) are threadably secured within blind holes (37), wherein the blind holes (37) extend orthogonally from the upper surface (35) towards the bottom surface of the lower hub portion (26). Corresponding through holes (38) (see FIGS. 13 and 14) are provided in the upper hub portion (24) for slidably receiving the alignment pins (36). Through holes (38) are used for receiving the alignment pins (36) so that the pins are visible from above during assembly. It will be understood, however, that blind holes may be provided instead of through holes (38). The holes (38) for receiving the alignment pins (36) are positioned radially outward of the through holes (29). It will be understood that any number of alignment pins (36) and corresponding holes may be provided. However, in the embodiment shown, given the size of the center hub (22) (e.g., about 15 to about 23 centimeters in diameter) and since the upper and lower hub portions (24, 26) are symmetrical about the rotational axis (A) of the feed turret assembly, two alignment pins are generally sufficient.

Central opening (30) of upper hub portion (24) and central opening (39) of lower hub portion (26) have substantially the same diameter and receive the feed turret stud, bearing, seal sleeve, and oil seals of the can seamer when the center hub is mounted to the seamer. To provide a sealing engagement between the center hub (22) and seal sleeve (214 in FIG. 7A), upper and lower annular hub seals (40A, 40B) may be secured within central openings (30, 39) of the upper and lower hubs (24, 26) (see FIGS. 8-10). Hub seals (40A, 40B) may comprise, for example, an elastomeric material suitable for sealing. The seal sleeve and upper portion of the feed turret stud (212 in FIG. 7A) of the can seamer may be received through the center aperture of the hub seals (40A, 40B), with the hub seals face-to-face against the seal sleeve. Also, in the embodiment shown, an optional seal such as in the form of an O-ring (41) is provided out the outer circumference of the center hub. In the particular embodiment shown, O-ring (41) is located within a groove extending about the circumference of the lower hub portion (26) for providing a seal between the center hub and the feed turret, as further explained below.

Besides being adapted for mounting to the can seamer to allow for driven rotation of the feed turret assembly, the center hub (22) is also configured to direct purge gas (e.g., $CO_2$) into the headspace between the can end and the surface of the product within the container. In one exemplary embodiment, the center hub (22) is configured to direct purge gas into gas flow chambers (78) of the feed turret and discharge purge gas from orifices (79) arranged around the arcuate can pockets (P) such that the purge gas is expelled over the open end of a filled can.

In the depicted exemplary embodiment, a plurality of purge gas inlets (44) may be provided in the upper surface (31) of the upper hub portion (24), and a corresponding plurality of gas outlets (48) are provided in the outer peripheral side of the assembled center hub (22). A gas flow chamber (50) extends from each purge gas inlet (44) to a corresponding gas outlet (48). To provide gas chambers (50), a plurality of upper channels (45) are provided in the underside of the upper hub portion (24), each extending radially outward from one of the gas inlets (44) to the outer peripheral edge of the upper hub portion (24) (see FIG. 14). A plurality of lower channels (46) are provided in the upper surface (35) of the lower hub portion (26), each extending radially outward to the outer peripheral edge of the lower hub portion (26) (see FIG. 11). When the center hub (22) is assembled, a plurality of gas flow chambers (50) are formed by the upper channels (45) and the lower channels (46), with the gas outlets (48) formed by the radially outward termini of the upper and lower channels (45, 46). In this manner, a gas flow chamber (50) provides fluid communication between each gas inlet (44) and a corresponding gas outlet (48) in the outer periphery of the center hub (22).

In the embodiment shown, the sidewalls (47) of the upper channels (45) extend generally orthogonal to the upper and lower surfaces (31, 32) of the upper hub portion (24), with a smooth (e.g., arcuate) transition between the sidewalls (47) and the upper wall (49) of each upper channel (45). The upper wall (49) extends generally parallel to the upper and lower surfaces (31, 32) of the upper hub portion (24). Thus, the cross-sectional shape of the upper channels (45) is generally rectangular (with rounded or arcuate corners). It is also noted that in the exemplary embodiment shown, the sidewalls (47) extend radially outward such that the width of each upper channel increases in the outwardly radial direction.

Also in the embodiment shown, the sidewalls (51) of the lower channels (46) extend upward from the bottom wall (53) at an angle (i.e., are beveled or chamfered) with respect to a perpendicular through the upper surface (35) of the lower hub portion (26). The bottom wall (53) is generally flat, extending substantially orthogonal to the rotational axis (A). Each lower channel (46) includes a curved inner wall (52) that also extends at an angle (i.e., is beveled or chamfered) with respect to a perpendicular through the upper surface (35). Thus, the cross-sectional shape of the lower channels (46) may be generally trapezoidal. Also, the sidewalls (51) extend radially outward such that the width of each lower channel increases in the outwardly radial direction. As a result, when the center hub is assembled, the gas flow chambers (50) generally have a cross-sectional shape in the form of an irregular, convex hexagon, but substantially symmetrical with respect to a plane that includes the rotational axis (A) of the feed turret assembly (which extends through the center of the gas flow chamber).

The gas flow chambers (50) are arranged to smoothly redirect gas flow around a 90° bend (see FIG. 8) between the gas inlets (44) and the gas outlets (48). As such, the trapezoidal cross-sectional shape of the lower channels (46) and the lack of sharp corners and edges help to reduce the turbulence of purge gas flowing through the chambers (50) so that the purge gas flows through the gas chambers in the feed turret as a laminar flow. Further, since the cross-sectional area of the flow chambers (50) increases due to the sidewalls (47, 51) extending radially outward in the direction of gas flow, the velocity of the purge gas decreases, which further induces laminar flow of the purge gas.

Conventional (OEM) feed turret arrangements do not include gas flow chambers that induce laminar gas flow, as they include, for example, flow chamber configurations that cause purge gas to impinge upon vertical walls and sharp edges that increase, rather than reduce, turbulence in the purge gas. This turbulent gas flow causes a Venturi effect as the gas is expelled into the can pockets, drawing air (i.e., oxygen) beneath the can end and even into the feed turret itself (beneath the cover plate). As a result, a greater volume of purge gas must be used to ensure that the sealed containers do not have excess dissolved oxygen (which shortens product shelf life).

The gas flow arrangement of the feed turrets according to the present disclosure allow for a reduction in $CO_2$ purge gas consumption of up to 24% as compared to conventional feed turrets, while achieving the same level of dissolved oxygen in the sealed containers. Alternatively, or in addition to reducing purge gas requirements, the gas flow arrangement of the feed turrets according to the present disclosure can provide for reduced levels of dissolved oxygen without the use of more purge gas, as compared to conventional feed turrets.

Figure 7:
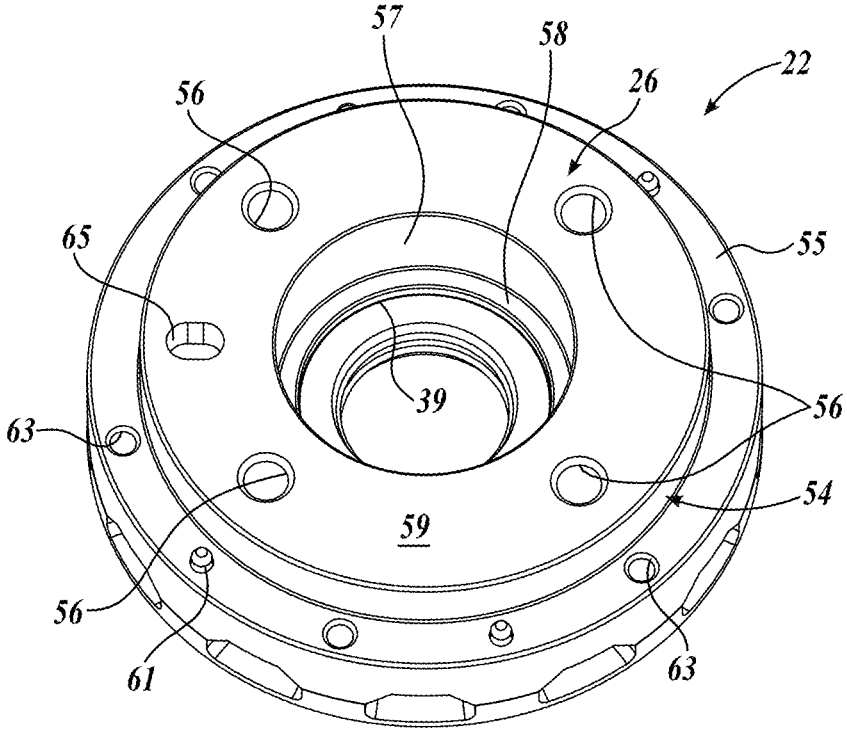
FIG. 7 is an isometric view, from below, of the center hub of the feed turret assembly of FIG. 2.
Figure 7A:
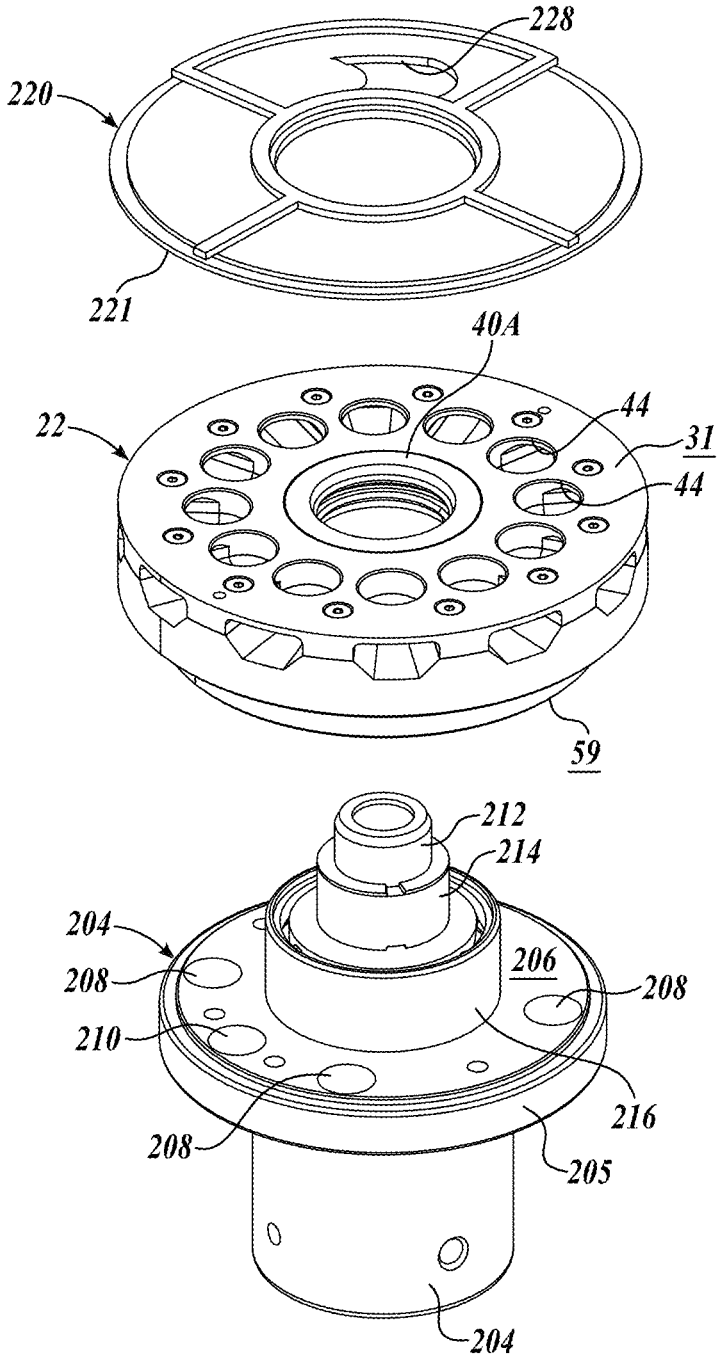
FIG. 7A is an exploded view depicting the center hub of FIGS. 6 and 7 being mounted to the can seamer.
Figure 8:
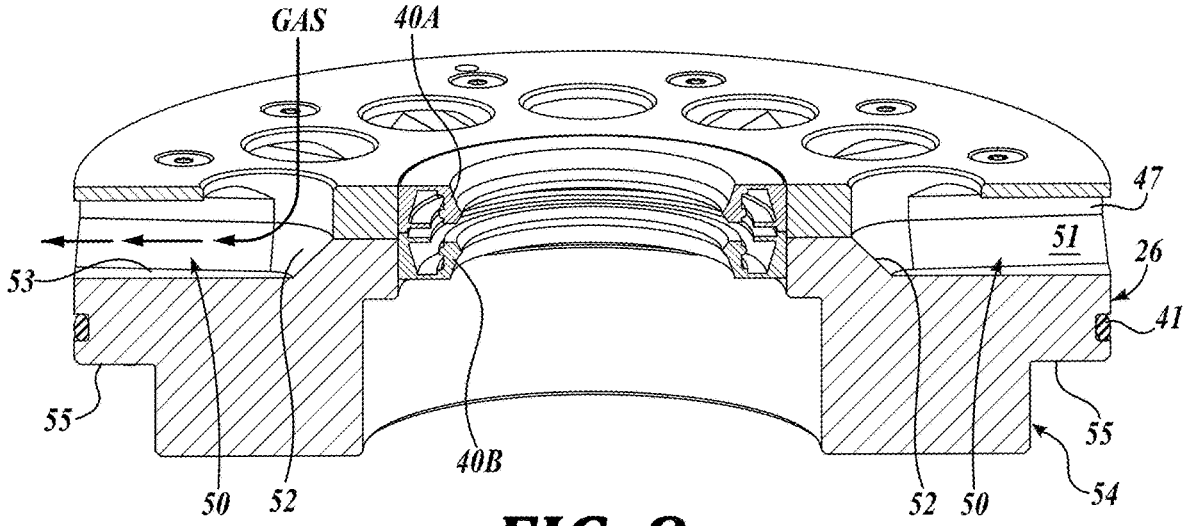
FIG. 8 is a cross-sectional view of the center hub of FIG. 6, taken along the line 8-8 thereof.
Figure 9:
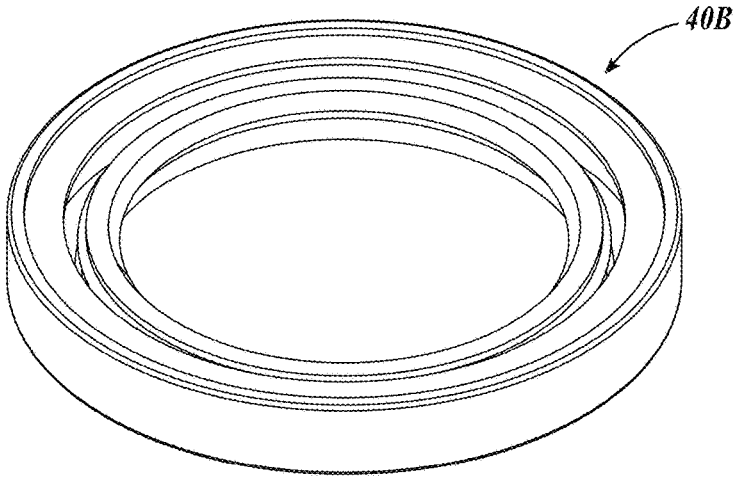
FIG. 9 is an isometric view, from above, of the lower hub seal of the center hub of FIG. 6.
Figure 10:
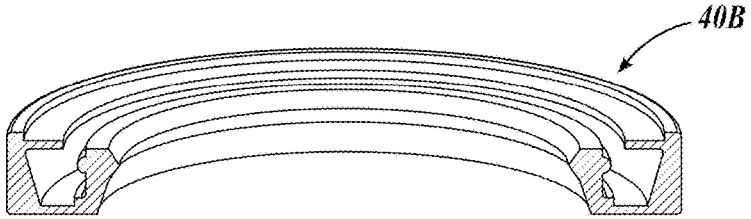
FIG. 10 is a cross-sectional view of the lower hub seal of FIG. 9.
Figure 11:
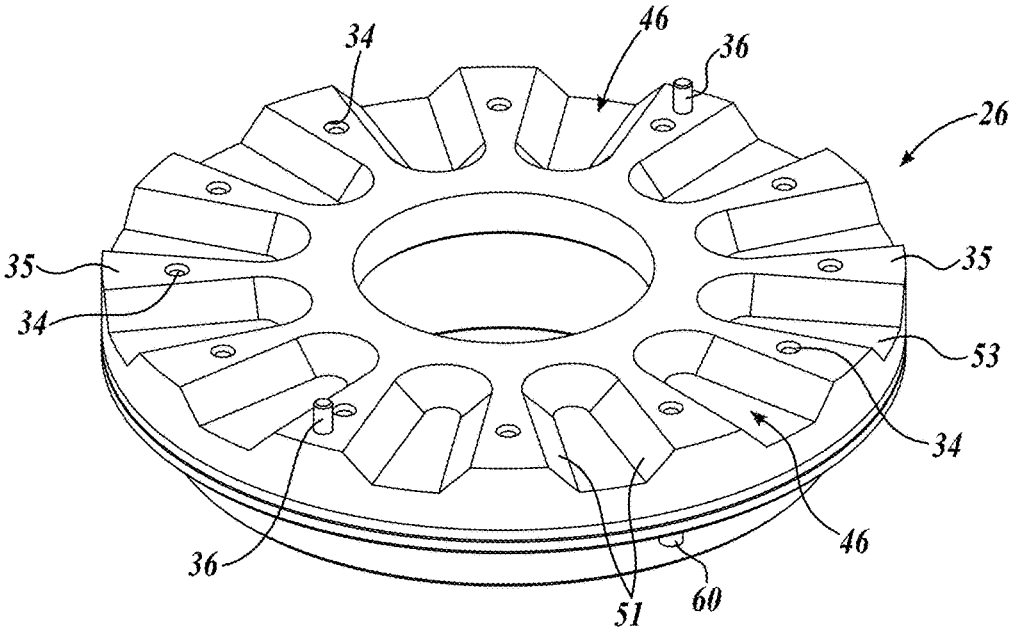
FIG. 11 is an isometric view, from above, of the lower hub portion of the center hub of FIG. 6.

As best seen in FIGS. 7 and 8, the lower hub portion (26) includes a cylindrical extension (54) extending away from the bottom of the lower hub portion (26). Thus, a lower shoulder (55) is provided about the circumference of the lower hub portion (26). Apertures are provided in the cylindrical extension (54) for mounting the center hub (22) to a can seamer. In the embodiment shown, these apertures include threaded blind holes (56), arrayed about the central opening (57) of the cylindrical extension (54) and open to the bottom surface (59) of cylindrical extension (54) (i.e., the bottom surface of the center hub). The diameter of the central opening (57) is less than the diameter of the central opening (39) of the lower hub portion (26) such that an internal shoulder (58) is provided at the upper end of the central opening (57).

Figure 24:
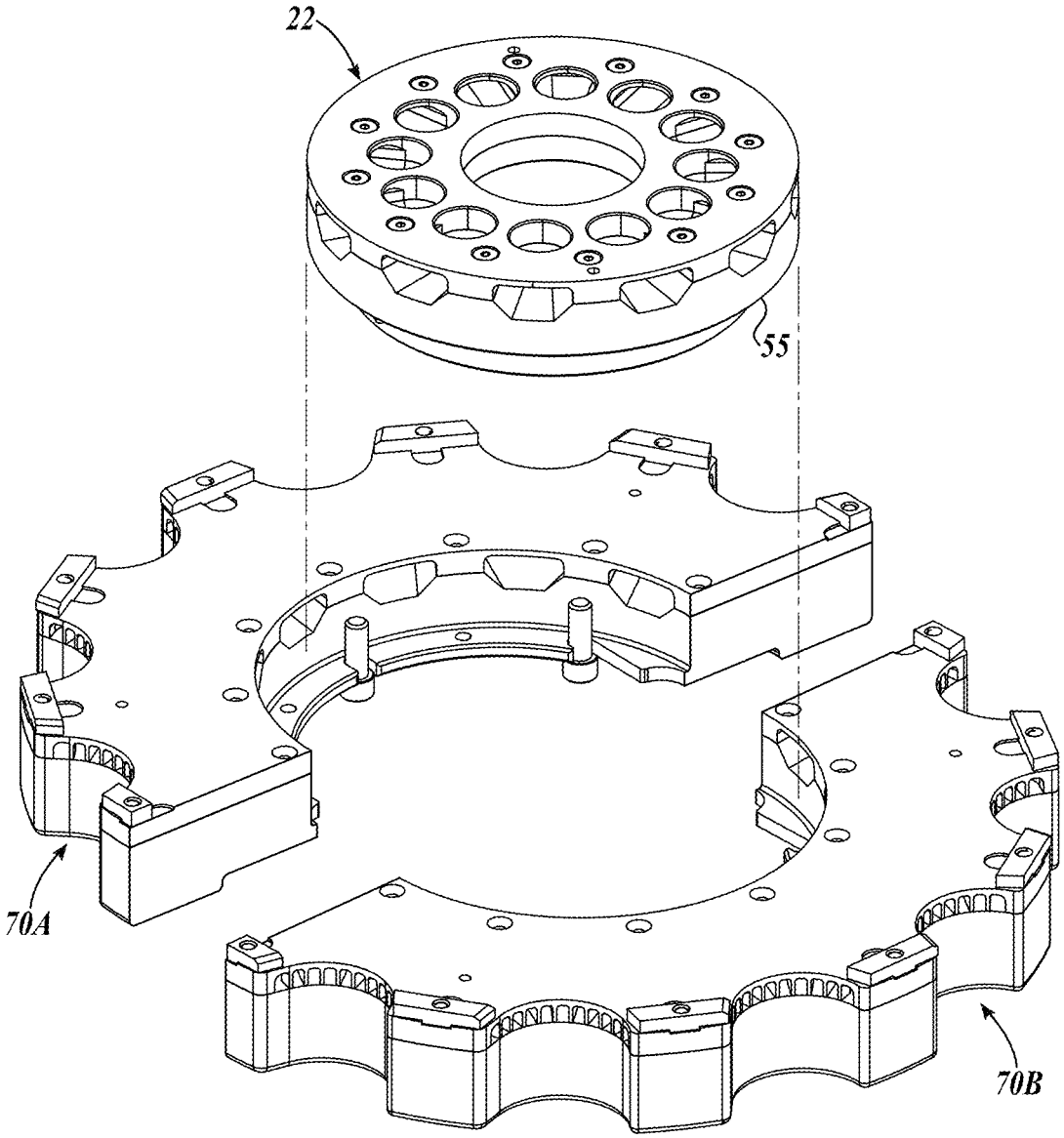
FIG. 24 is an isometric exploded view of the feed turret assembly of FIG. 2, depicting the mounting of the feed turret over the center hub.
Figure 25:
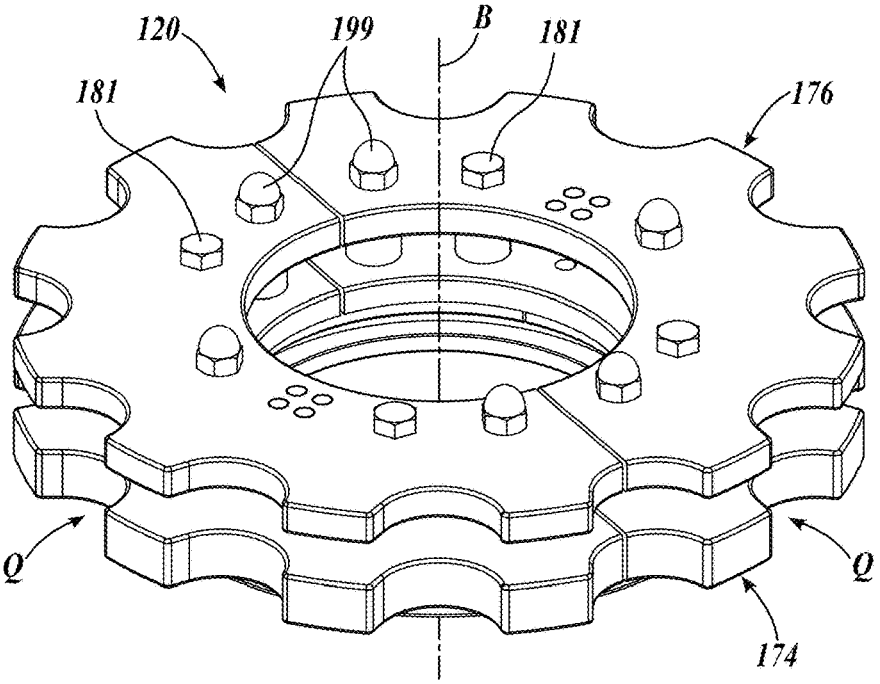
FIG. 25 is an isometric view, from above, of a discharge turret assembly according to one embodiment of the present disclosure.
Figure 26:
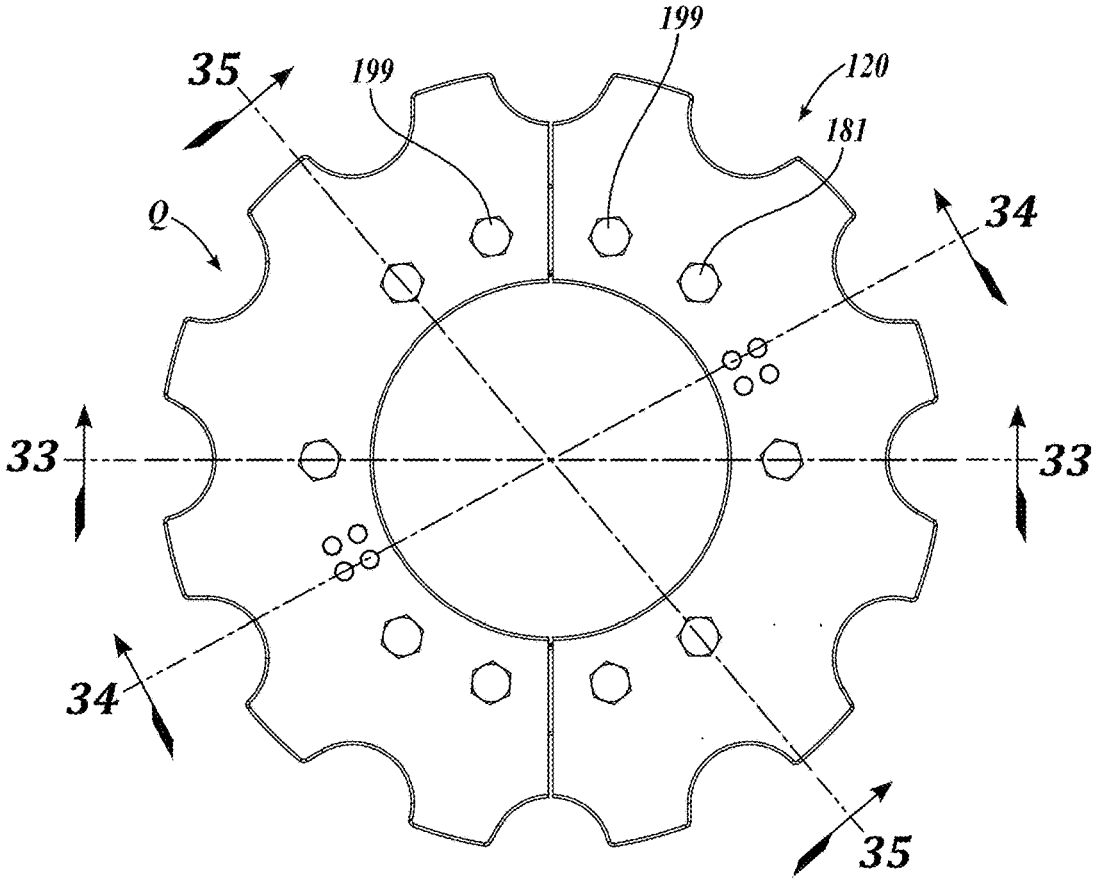
FIG. 26 is a top plan view of the discharge turret assembly of FIG. 25.

The threaded blind holes (56) extending into the center hub from the bottom surface (59) of the lower hub portion (26) can be used to alignably secure the center hub (22) to a can seamer. When so secured, the internal shoulder (58) will abut against a bearing (216) on the feed turret stud (212). As shown in the exploded view of FIG. 7A, the center hub (22) is mountable to a flange (205) of a seamer turret hub (204) of the can seamer, with the bottom surface (59) of the center hub (22) abutting against the upper surface (206) of the flange (205). When so mounted to the seamer turret hub (204), the shoulder (55) of the center hub extends radially outward of the outer periphery of the flange (205) of the seamer turret hub (204). This allows the feed turret halves (70A, 70B) to be attached to the shoulder (55) of the center hub without removing the center hub from the can seamer, as seen in FIG. 24.

Through holes (208) are provided in the flange (205) of the seamer turret hub (204), which are arranged for alignment with the threaded blind holes (56) of the cylindrical extension (54) of the lower hub portion of the center hub. Threaded fasteners (not shown) inserted through the through holes (208) of the flange (205) from below and into the threaded holes (56) of the center hub are used to secure the center hub (22) to the seamer turret hub (204). When the center hub (22) is secured to the seamer turret hub (204), rotation of the seamer turret hub causes the center hub (22) (and the feed turret (70) mounted thereto) to rotate during use.

The bearing (216) is received within the central opening (57) of the cylindrical extension (54) of the center hub (22), from below. Also, the feed turret stud (212) is received within the center opening of the center hub such that the upper end of the feed turret stud is positioned above the upper hub seal (40A), and the seal sleeve (215) is positioned within the hub seals (40A, 40B) (see FIG. 38).

When the center hub (22) is secured to the seamer turret hub (204) of the seamer, a seamer turret gas manifold ring (220) of the can seamer can be sealingly engaged with the upper surface (31) of the center hub so as to prevent purge gas loss. Specifically, the bottom surface (221) seamer turret gas manifold ring (220) is in sealing engagement with the upper surface (31) of the center hub (22), with the seamer turret gas manifold ring (220) remaining stationary while the seamer turret hub (204) and center hub (22) rotate during use. The seamer turret gas manifold ring (220) includes a gas aperture (228) that sequentially aligns with gas inlets (44) of the center hub (22) as the center hub rotates. Purge gas from a purge gas supply (not shown) may flow through the gas aperture (228) into the gas inlets (44) during use.

During use, the center hub (22) may be mounted to the can seamer as described above. It is not necessary to remove the center hub (22) from the can seamer in order to change the feed turret assembly (20) to seal different sizes and/or configurations of cans. Instead, only the feed turret (70) portion of the assembly (20) is changed. Thus, center hub (22) can be used with two or more different feed turrets (70) to accommodate different sizes of cans. Feed turret assembly timing is adjusted by the positioning of the center hub (22), as explained below. Once the center hub (22) has been mounted to the can seamer and adjusted for timing, a size changeover only requires mounting of a different feed turret (70) to the center hub.

The same center hub can therefore be used with differently sized feed turrets (70), and remains mounted to the seamer during a feed turret changeover. It is also not necessary to remove the feed turret stud, sleeve, bearing, or oil seal for a feed turret changeover. Further, in some embodiments the feed turret (70) is provided as two halves, which can weigh less than 30 pounds each and are individually mounted to the center hub. Thus, feed turret changeovers (e.g., for a new can size) are much faster and can even be done by a single worker. In contrast, conventional feed turrets are a single structure (there is no separate center hub), and weigh as much as 60 pounds or more (requiring at least two workers to perform a changeover).

Accordingly, embodiments of the present disclosure include feed turret systems comprising two or more feed turrets (70) having different sizes, numbers, or configurations of arcuate pockets (P), and a common center hub (22) that will accommodate the two or more different feed turrets (70). For example, a first feed turret is configured to be used for seaming cans of a first diameter and/or height, and a second feed turret is configured to be used for seaming cans of a second diameter and/or height. The feed turrets can be exchanged on the can seamer without first removing the center hub (22).

The feed turret (70) is mounted to the center hub (22) using, for example, threaded fasteners. As further explained below, when the feed turret (70) comprises two halves (e.g., first and second feed turret halves (70A, 70B) shown in FIG. 24), the feed turret (70) can be mounted to the center hub (22) while the center hub remains secured to the seamer turret hub (204), as depicted in FIG. 24. The feed turret (70) may be bifurcated such that the first and second feed turret halves (70A, 70B) are substantially identical or identical (hereinafter simply referred to as "identical" halves).

To aid in the assembly and alignment of the center hub (22) with the feed turret (70), one or more alignment pins (60) may extend between the shoulder (55) of the lower hub portion (26) and the annular flange (72) of the feed turret (70). The alignment pins (60) are threadingly secured within blind holes (61) located in lower shoulder (55) of the lower hub portion (26) (see FIG. 12). During securement of the feed turret (70) to the center hub (22), the alignment pins (60) are slidingly received within through holes (73) located in the annular flange (72) of the feed turret (see FIG. 18B).

In the embodiment shown, four alignment pins (60) are threadably secured within blind holes (61) extending orthogonally from the bottom surface of lower shoulder (55) (i.e., parallel to the rotational axis (A)). Once again, through holes (73) are used for receiving the alignment pins (60) so that the pins are visible during assembly. It will be understood that any number of alignment pins (60) and corresponding holes may be provided. However, since the feed turret (70) comprises two identical halves (i.e., is bifurcated), two alignment pins (60) are provided for each half of the feed turret. Since the center hub (22) and feed turret (70) are symmetrical about the rotational axis (A), two alignment pins for each half of the feed turret (four in total) are generally sufficient.

Figure 12:
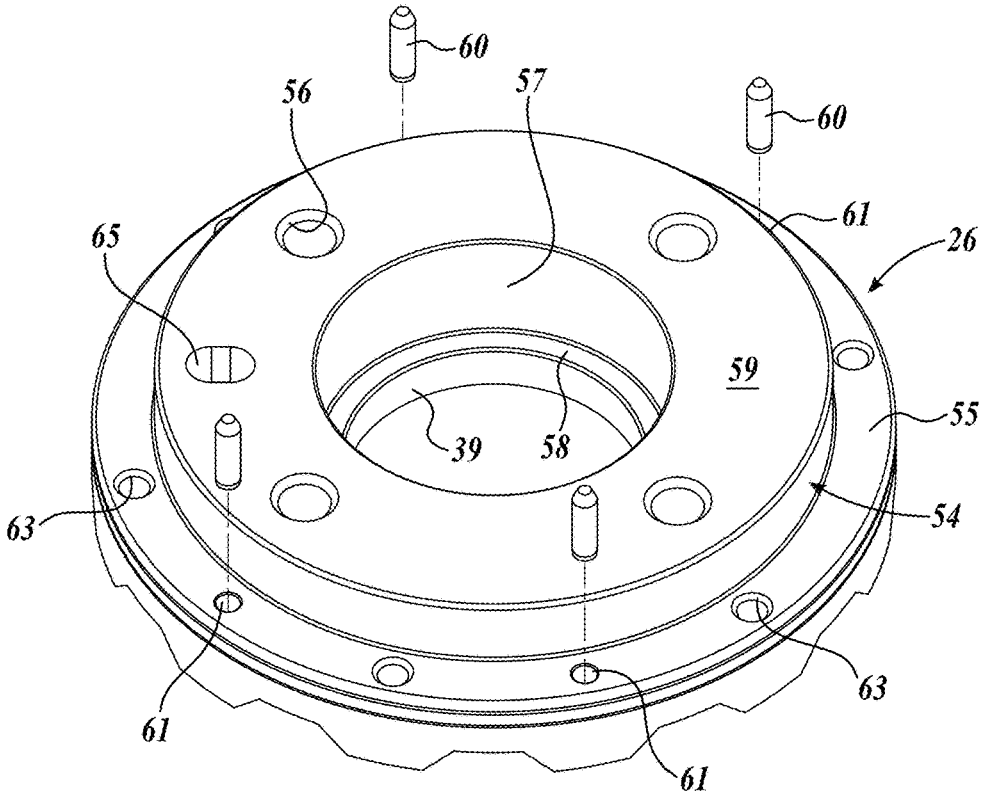
FIG. 12 is an exploded isometric view of the lower hub portion of the center hub of FIG. 6.
Figure 13:
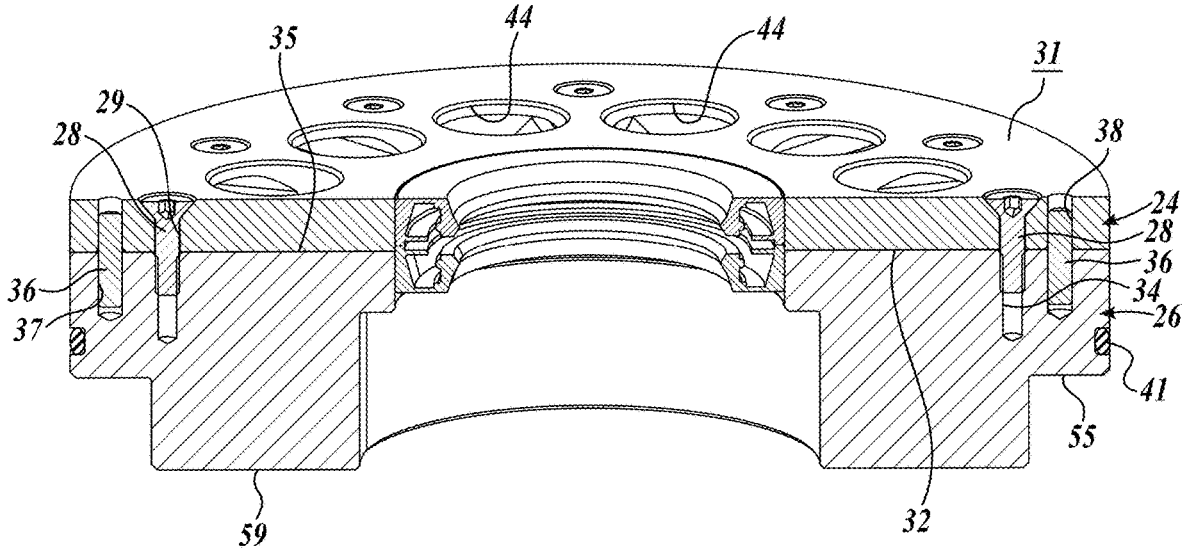
FIG. 13 is a cross-sectional view of the center hub of FIG. 6, taken along the line 13-13 thereof.
Figure 14:
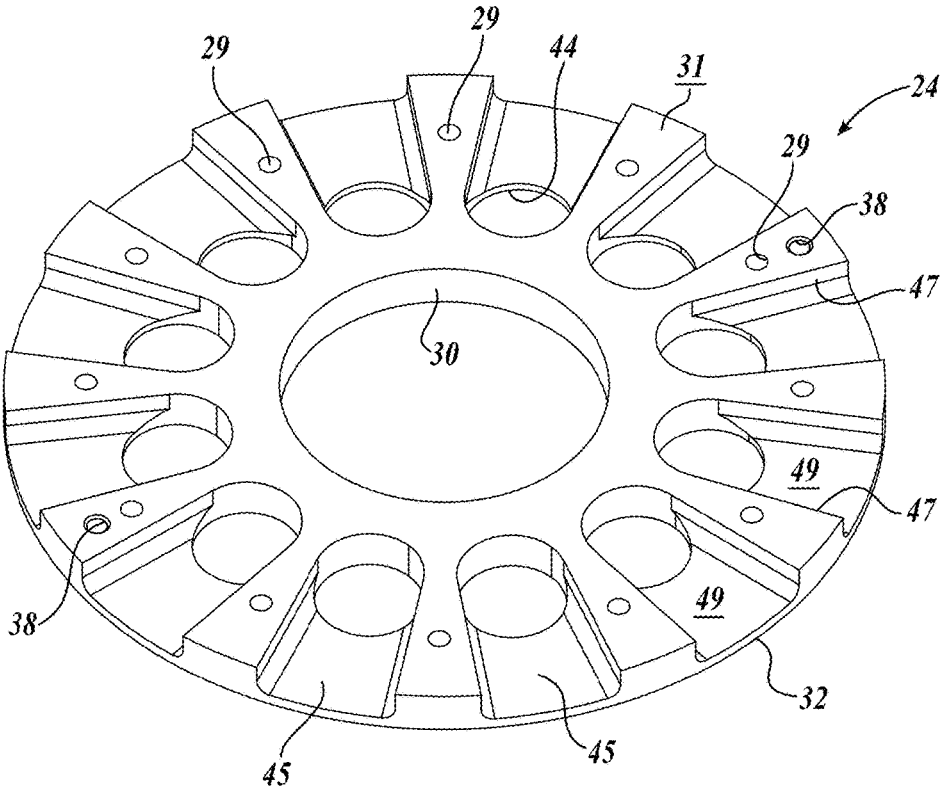
FIG. 14 is an isometric view of the upper hub portion of the center hub of FIG. 6, viewed from below.

Internally threaded blind holes (63) are also provided in lower shoulder (55) of the lower hub portion (26) (see FIG. 12). In the embodiment shown, six blind holes (63) are provided, symmetrically arrayed about the lower shoulder, and extend axially (i.e., parallel to the rotational axis (A)). As further described herein, threaded blind holes (63) may be used to secure the feed turret (70) to the center hub (22) (e.g., using threaded bolts).

The feed turret (70) comprises an annular feed turret body (74) and an annular cover plate (76) secured thereto. The feed turret embodiment shown and described herein is configured as two identical halves (as first and second halves 70A, 70B) due to the size and weight of the feed turret. By providing the feed turret as two halves, assembly and handling of the feed turret is more easily facilitated. For instance, the feed turret, as two halves, can be mounted to the center hub while the center hub is mounted to a can seamer (e.g., to seamer turret hub (204). However, it will be understood that each of the feed turret body (74) and cover plate (76) can be configured as a unitary structure (i.e., one feed turret body and one cover plate), particularly for smaller feed turrets. As yet another alternative, the feed turret can be configured to comprise first and second feed turret body halves, affixed to a unitary cover plate. As a still further alternative embodiment, the feed turret (70) can be fabricated as a unitary component (i.e., a unitary feed turret, without a separate body and a separate cover plate).

In the embodiment shown, the two halves (first and second feed turret bodies and first and second cover plates) are divided along a radial line (a juncture) that extends between two gas flow chambers (78) (see, e.g., FIG. 15B) rather than along a radial line that intersects one or more gas flow chambers. This arrangement helps to prevent purge gas from escaping the flow chambers along the intersection between adjacent halves. In the embodiment shown, the juncture, corresponding to the radially extending end walls (R, see FIG. 15B) of each feed turret half (70A, 70B), extends along a plane that includes the rotational axis (X) (i.e., the juncture is orthogonal to the rotational axis (X)).

Figure 16:
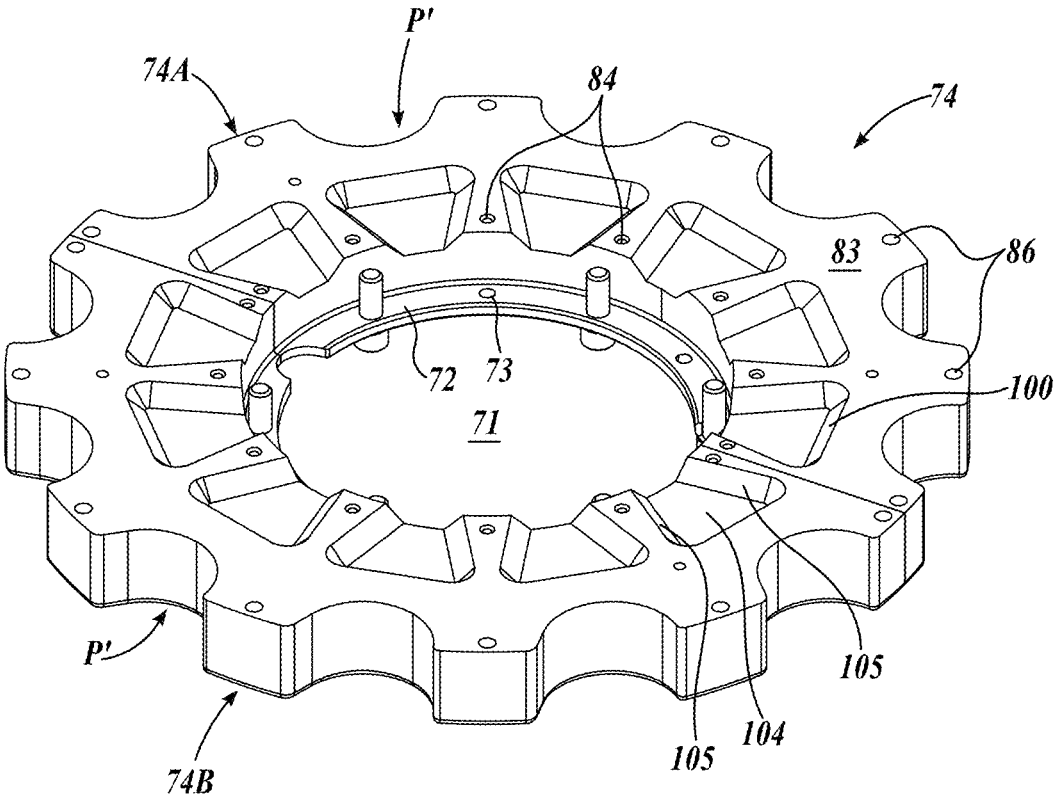
FIG. 16 is an isometric view of the feed turret body of FIG. 15, viewed from above, and including the hub mounting bolts.

Feed turret body (74) comprises a bifurcated annular body, comprising a first feed turret body (74A) and a second feed turret body (74B) (see FIG. 16). An annular flange (72) is provided on the feed turret body (74), at the base of the annular chamber (71) therein, as mentioned previously. The through holes (73) extend through the flange (72), which are adapted to receive the alignment pins (60) of the center hub (22). In the embodiment shown, two such through holes (73) are provided in the flange (72) of each of the first and second feed turret body halves (74A, 74B).

Figure 18A:
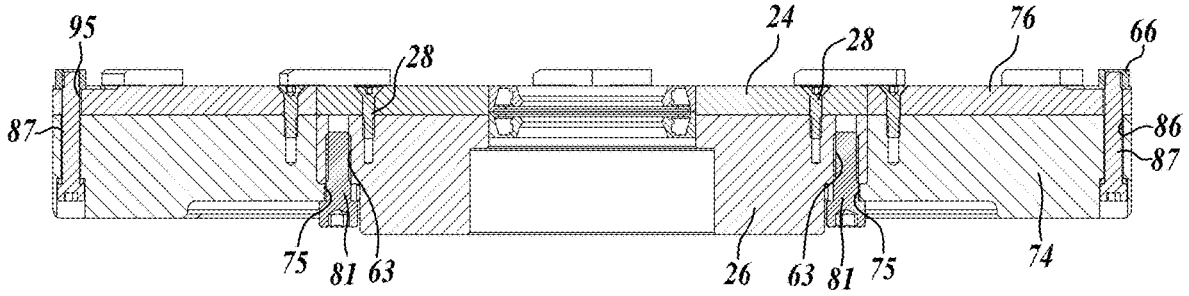
FIG. 18A is a cross-sectional view of the feed turret assembly of FIG. 4, taken along the line 18A-18A thereof.
Figure 18B:
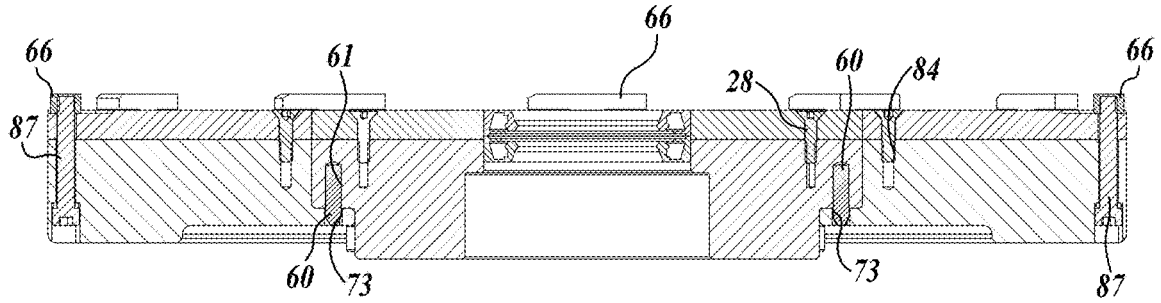
FIG. 18B is a cross-sectional view of the feed turret assembly of FIG. 4, taken along the line 18B-18B thereof.
Figure 18C:
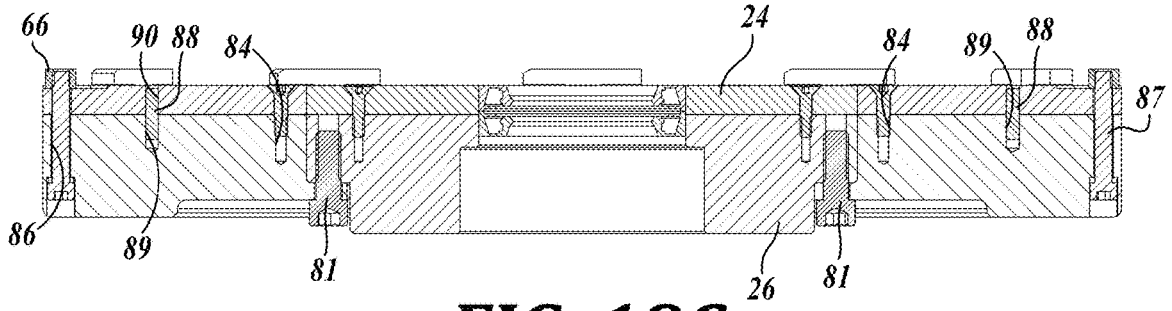
FIG. 18C is a cross-sectional view of the feed turret assembly of FIG. 4, taken along the line 18C-18C thereof.

Additional through holes (75) are also provided in flange (72), with three such holes (75) equally spaced around the flange (72) each of the first and second feed turret body halves (74A, 74B). Through holes (75) are arranged such that, when the body of the feed turret (70) is mounted to the center hub (22), the through holes (75) are aligned with the internally threaded blind holes (63) in the lower hub portion (26). Threaded hub mounting bolts (81) are used to secure the feed turret (70) to the center hub (22), as best seen in FIGS. 18A and 18C. It will be understood that any number of threaded mounting bolts (81) or other fasteners and corresponding holes may be provided for securing the feed turret (70) to the center hub (22).

Figure 17:
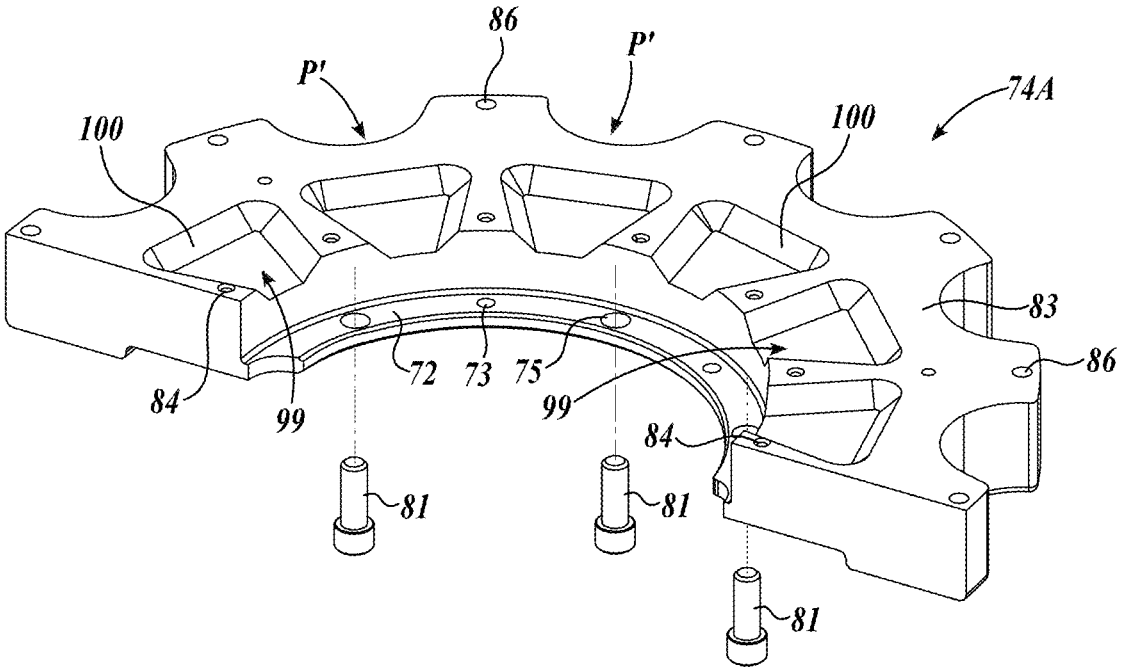
FIG. 17 is an exploded isometric view of the first half of the feed turret of FIG. 15, depicting the hub mounting bolts exploded.

A plurality of arcuate can pockets (P') are arrayed about the outer periphery of the feed turret body (74) (see FIGS. 16 and 17), which form the lower portion of the can pockets (P) when the feed turret is assembled. The annular chamber (71) of the feed turret (70) is bounded by the upper surface of the flange (72) as well as the inner annular wall (82) of the feed turret body (74) (see, e.g., FIGS. 15A and 17). The upper surface (83) of the feed turret body is substantially flat (i.e., orthogonal to the rotational axis A).

A plurality of internally threaded blind holes (84) extend orthogonally from the upper surface (83) of the feed turret body (74) towards the bottom surface of the feed turret body. In the embodiment shown, the threaded blind holes (84) are located adjacent to inner annular wall (82). The threaded blind holes (84) are used to secure the cover plate (76) to the feed turret body using threaded bolts (28) or other fasteners (as described below).

A second set of through holes (86) extend orthogonally between the upper surface (83) and the bottom surface of the feed turret body. These outer through holes (86) are located adjacent to the outer periphery of the feed turret body (74), between adjacent can pockets (P'). Threaded bolts (87) (or other fasteners) are inserted through the bottom of the feed turret body into the through holes (86), and the threaded bolts (87) extend through aligned through holes (95) in the cover plate (76), as described below. Each of the bolts (87) is used to secure a cap pusher (66) to the upper surface of the cover plate (76) adjacent the outer periphery of the cover plate, adjacent to and slightly overlapping the can pockets (P) (see FIGS. 2 and 5). The cap pushers (66) serve to hold the lids in position during the transportation of the lids from the feeding end (for the lids) to makeup with the cans. It will be noted that the cap pushers (66A, 66B) adjacent the ends of each turret half (70A, 70B) are split in half, as shown.

To aid in the assembly and alignment of the cover plate (76) with the feed turret body (74), one or more alignment pins (88) extend between the feed turret body and the cover plate. The alignment pins (88) are threadingly secured within internally threaded blind holes (89) that extend orthogonally from the upper surface (83) of the feed turret body (74) towards the bottom surface of the feed turret body. In the embodiment shown, the threaded blind holes (89) are located radially between one of the threaded blind holes (84) and one of the through holes (86). It will be understood, however, that the threaded blind holes (89) for alignment pins (88) can be located in a variety of other locations on the feed turret body.

Figure 15B:
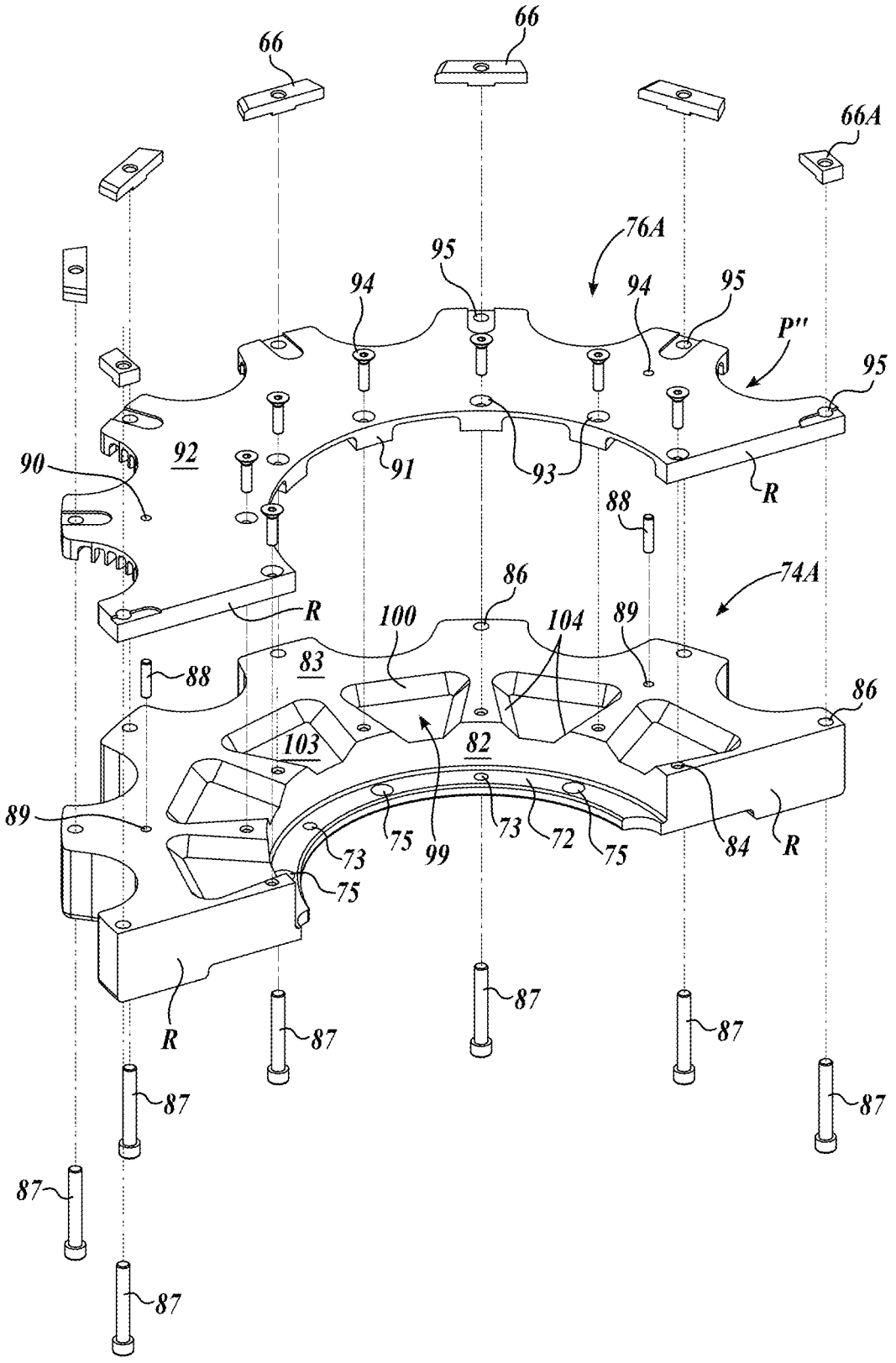
FIG. 15B is an exploded isometric view of the first half of the feed turret of FIG. 15A.
Figure 21A:
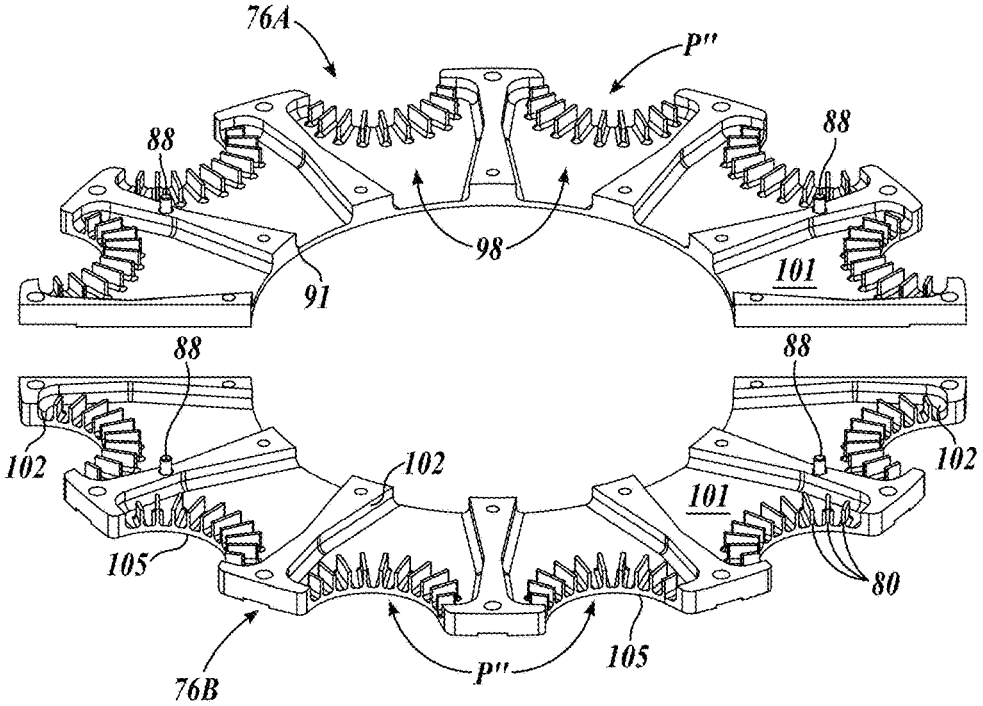
FIG. 21A is an isometric view of the feed turret body of FIG. 19, viewed from below and with the two halves of the feed turret body separated.

During securement of the cover plate (76) to the feed turret body (74), the alignment pins (88) are slidingly received within through holes (90) located in the cover plate (see FIG. 15B). As an alternative, the alignment pins can be threadably secured within holes (90) and slidingly received within holes (89) in the feed turret body (as seen in FIG. 21A). It will be understood that any number of alignment pins (88) and corresponding holes may be provided. However, when the feed turret (70) comprises two identical halves (i.e., is bifurcated), two alignment pins (88) may be provided for each half of the feed turret. Since the feed turret (70) is symmetrical about the rotational axis (A), two alignment pins for each half of the feed turret (four in total) are generally sufficient.

Figure 19:
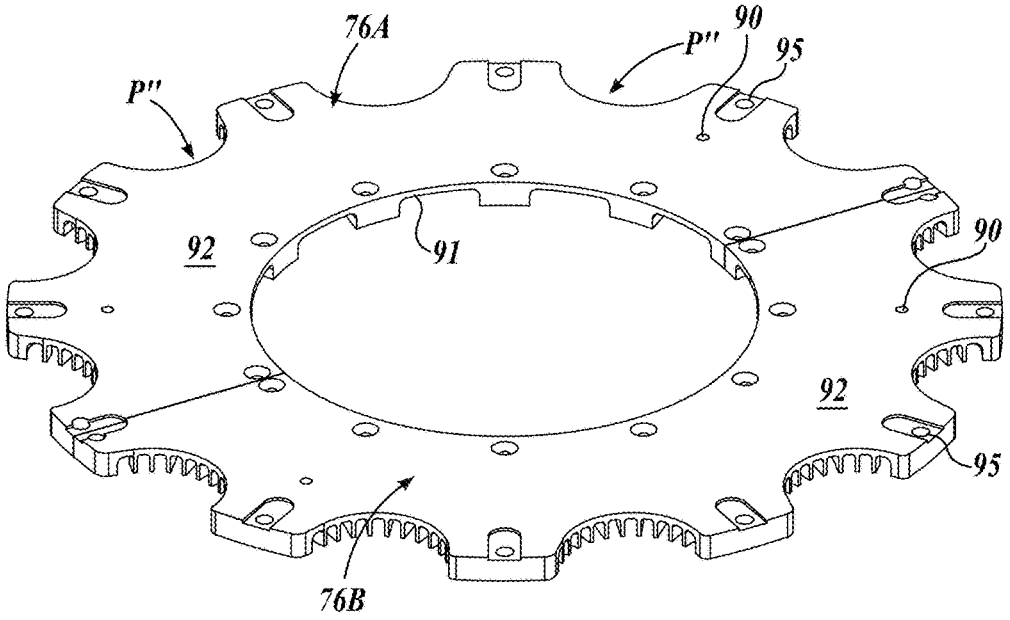
FIG. 19 is an isometric view, from above, of the feed turret body of the feed turret assembly of FIG. 15.
Figure 20:
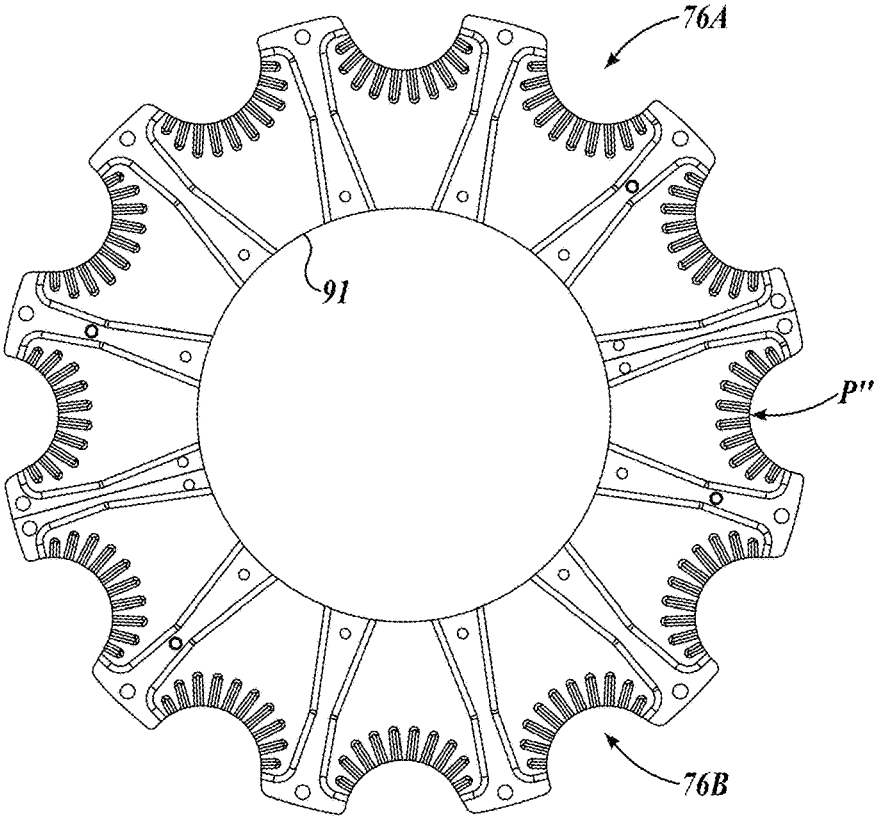
FIG. 20 is a bottom plan view of the feed turret body of FIG. 19.

Cover plate (76) comprises a bifurcated annular plate, formed of a first cover plate (76A) and a second cover plate (76B) (see FIGS. 19 and 21). A plurality of arcuate can pockets (P") are arrayed about the outer periphery of the cover plate (76) and form the upper portion of the can pockets (P) when the feed turret is assembled. The annular chamber (71) of the feed turret (70) is further bounded by the inner annular wall (91) of the cover plate (76B) (see, e.g., FIGS. 19 and 21). The upper surface (92) of the cover plate is substantially flat (i.e., orthogonal to the rotational axis A).

A plurality of through holes (93) extend orthogonally from the upper surface (92) of the cover plate through the thickness of the cover plate, adjacent to inner annular wall (91). When the cover plate is placed over the feed turret body, the through holes (93) align with the threaded blind holes (84) such that threaded bolts (94) can be used to secure the cover plate (76) to the feed turret body (74).

Similarly, a second set of through holes (95) extend orthogonally between the upper surface (92) and the bottom surface of the cover plate. These outer through holes (95) are located adjacent to the outer periphery of the cover plate, between adjacent can pockets (P"). When the cover plate is placed over the feed turret body, the through holes (95) align with the through holes (86) of the feed turret body such that the threaded bolts (87) can be used to secure the cap pushers (66) to the upper surface (92) of the cover plate (76) adjacent the outer periphery of the cover plate adjacent and slightly overlapping the can pockets (P) (see FIGS. 2 and 5).

Together, when assembled, the feed turret body (74) and the cover plate (76) form a plurality of internal gas flow chambers (78) (see FIG. 5) arranged to communicate with the gas flow chambers (50) of the center hub. Each of the gas flow chambers (78) terminates at a plurality of orifices (79) arranged around the arcuate can pockets (P), proximate the upper surface (77) of the cover plate (76).

Figure 21B:
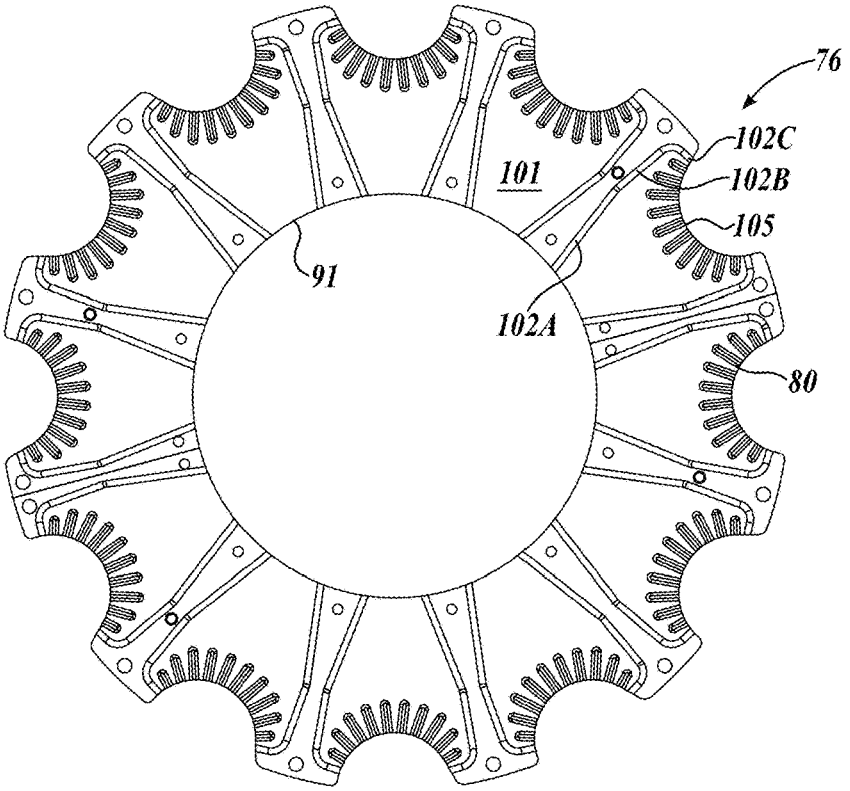
FIG. 21B is a bottom plant view of the feed turret body of FIG. 19.

The orifices are formed by a plurality of fins (80) extending downwardly from the underside of the cover plate (see FIGS. 21A and 21B). When the feed turret assembly (20) is mounted to a can seamer, purge gas pumped into gas inlets (44) of the center hub flows through the gas flow chambers (50) of the center hub into the gas flow chambers (78) of the feed turret, and is then expelled through the orifices (79) over the open ends of filled cans within the pockets (P), beneath the can ends (lids) positioned above the open ends of the cans. As explained below, the gas flow chambers (78) are configured such that the cross-sectional area of the gas flow chambers (78) is increased as the purge gas flows radially outward through the chambers (78), causing the velocity of the purge gas exiting the orifices (79) to be decreased. This prevents the formation of a Venturi effect, which allows for the use of less purge gas for evacuating oxygen (i.e., air) from the headspace of the cans.

The gas flow chambers (78) of the feed turret (70) are formed by a plurality of upper channels (98) provided in the underside of the cover plate (76) and lower channels (99) provided in the upper surface (83) of the feed turret body (74). Each upper channel (98) extends radially outward from inner annular wall (91) to the outer edge of the cover plate within the can pockets (P") (see FIGS. 21A and 21B). Each lower channel (99) extends radially between the inner annular wall (82) of the feed turret body and an upwardly sloped endwall (100) spaced radially inward of the periphery of the feed turret body (see FIG. 15B). When the cover plate is attached to the feed turret body to form the feed turret (70), a plurality of gas flow chambers (78) are formed by the aligned upper channels (98) and lower channels (99), with each flow chamber (78) terminating in a plurality of orifices (79) located around the arcuate can pockets (P).

As best seen in FIG. 22C, each orifice is bounded by the upper wall (101) of upper channels (98) (i.e., the underside of the cover plate (76)), the upper surface (83) of the feed turret body, and a pair of adjacent fins (80). In each can pocket (P), the two outermost orifices are bounded by the upper wall (101) of the upper channel (98), the upper surface (83) of the feed turret body, a sidewall (102) of the upper channel (98), and an immediately adjacent fin (80).

Looking first at the configuration of the lower channels (99) in the feed turret body (74), each has a generally trapezoidal cross-sectional shape (i.e., the cross-section in a plane parallel to the rotational axis (A) that intersects the lower channel (99)). Each lower channel (99) has a flat bottom wall (103) extending orthogonal to the rotational axis (A) and radially outward between the inner annular wall (82) of the feed turret body and an upwardly sloped endwall (100) spaced radially inward of the periphery of the feed turret body (see FIGS. 15B and 22C).

In the embodiment shown, the sidewalls (104) of the lower channels (99) extend at an angle greater than 90° with respect to the bottom wall (103) (e.g., an angle of between about 110 and about 160 degrees, or between about 125 and about 150 degrees). The sidewalls (104) also extend radially away from the inner annular wall (82) such that the opposing sidewalls (104) of each lower channel (99) diverge from each other in the radial direction, thereby increasing the width of each lower channel (99) in the radial direction. In other words, the width of each lower channel (99) at endwall (100) is greater than the width of the lower channel at inner annular wall (82).

Also, in the embodiment shown, the endwall (100) of each lower channel (99) extends at an angle greater than 90° with respect to the bottom wall (103) (e.g., an angle of between about 110 and about 160 degrees, or between about 125 and about 150 degrees). As a result of this configuration, the purge gas is redirected upward. This clears any air trapped under the cover and in the space adjacent the orifices.

Each of the upper channels (98) in the cover plate (76) has a generally rectangular cross-sectional shape (i.e., the cross-section in a plane parallel to the rotational axis (A) that intersects the upper channel (98)). Thus, each upper channel (98) has a generally flat upper wall (101) extending orthogonal to the rotational axis (A) and radially outward between the inner annular wall (91) of the cover plate and the arcuate outer peripheral edge (105) of the upper wall (101) of each upper channel (98), wherein the outer peripheral edge (105) forms the can pocket (P") adjacent the outermost extremity of each upper channel (98). The sidewalls (102) of the upper channels (98) extend generally orthogonal to the upper wall (101) of the channel, with a smooth (arcuate) transition between the sidewalls (102) and the upper wall (101) of each upper channel (98). The upper wall (101) extends generally parallel to the upper surface (92) of the cover plate (76). Thus, the cross-sectional shape of the upper channels (45) is generally rectangular (with rounded or arcuate corners).

Figure 22:
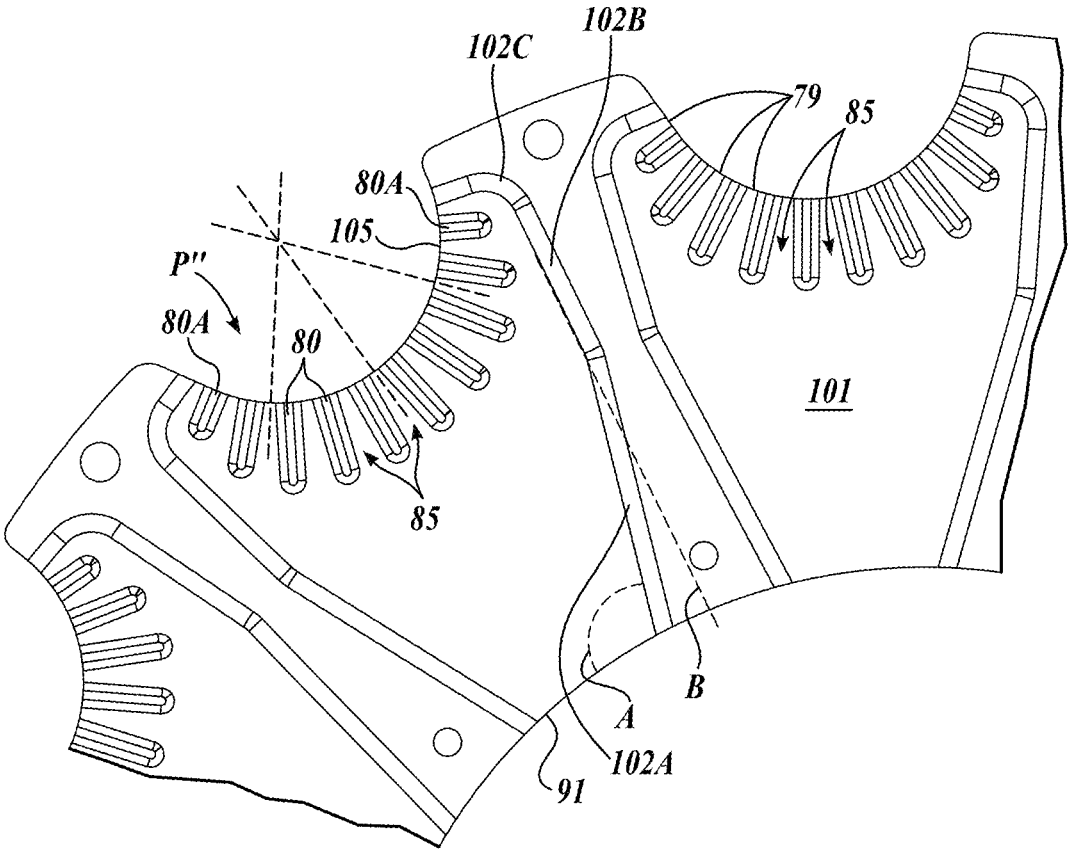
FIG. 22 is an enlarged view of a portion of FIG. 21B.

The sidewalls (102) of each upper channel (98) also extend radially away from the inner annular wall (91) such that the opposing sidewalls (102) of each upper channel (98) diverge away from each other in the radial direction, thereby increasing the width of each upper channel (98) in the radial direction. However, in the particular embodiment shown, the angle of each sidewall in the radial direction varies along the length of the sidewall. Thus, as shown in FIG. 22, each sidewall includes a first portion (102A) extending radially away from the inner annular wall (91) at an included angle (A). A second portion (102B), located radially outward of the first portion (102A), extends away from the inner annular wall (91) at an included angle (B) that is less than included angle (A).

When the cover plate is attached to the feed turret body, the transition from first sidewall portion (102A) to second sidewall portion (102B) occurs adjacent endwall (100) of the lower channel (99) of the feed turret body. Finally, a third portion (102C) of each sidewall (102) of the upper channels (98) extends from the second portion (102B) to the arcuate outer peripheral edge (105) of the upper wall (101) of the upper channel (98), and curves inward to the peripheral edge (105) (see FIG. 21B). The curved third portion (102C) of each sidewall directs gas flow towards the outermost fins (80) within the upper channel (98).

Figure 23A:
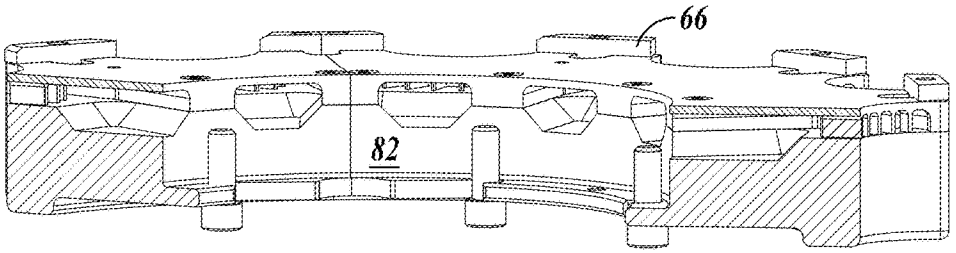
FIG. 23A is the same cross-sectional view as FIG. 5, but with the center hub omitted.
Figure 23B:
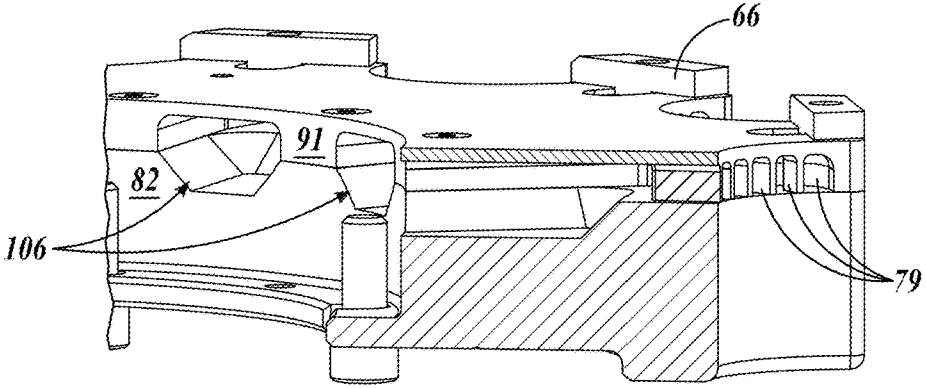
FIG. 23B is an enlarged view of a portion of FIG. 23A.
Figure 23C:
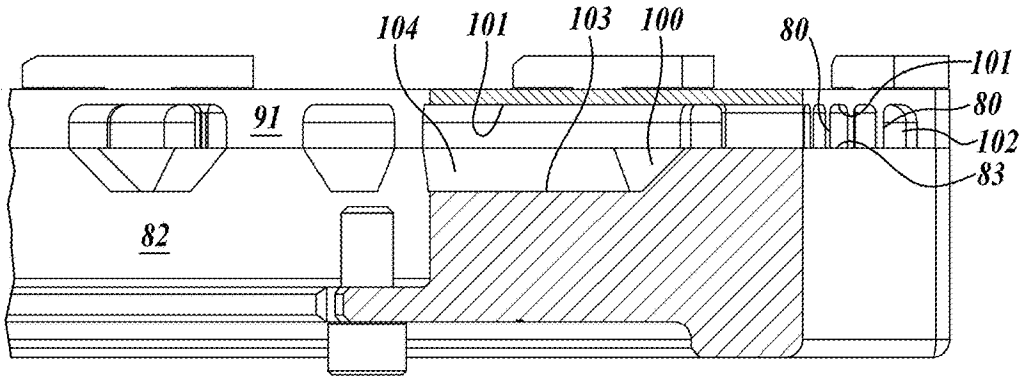
FIG. 23C is an enlarged cross-sectional side view similar to FIG. 23B.

When the cover plate (76) is mounted to the feed turret body (74), a plurality of gas flow chambers (78) are thus formed by the mating alignment of the upper channels (98) in the cover plate and the lower channels (99) in the feed turret body. Each gas flow chamber includes a gas inlet (106) (see FIG. 23B), with the gas inlets (106) arrayed around the periphery of the annular chamber (71). Each gas inlet (106) includes the intersection of an upper gas flow channel (98) with the inner annular wall (91) of the cover plate (76) and the intersection of an adjacent lower gas flow channel (99) with the inner annular wall (82) of the feed turret body (74). In the depicted embodiment, each gas inlet (106) has a shape corresponding to that of the gas outlets (48) provided in the outer peripheral side of the assembled center hub (22). When the feed turret (70) is mounted to the center hub (22), each of the gas inlets (106) will be aligned with one of the gas outlets (48) of the center hub such that each of the gas flow chambers (78) of the feed turret is in fluid communication with one of the gas flow chambers (50) of the center hub.

As best seen in FIGS. 21A-21B and FIG. 22, a plurality of fins (80) extend perpendicularly downward from the upper wall (101) into each upper channel (98). The fins also extend radially from the arcuate outer peripheral edge (105) of the upper wall (101) into the upper channel (98), with adjacent fins (80) spaced apart from one another and the outermost fins (80A) spaced apart from the adjacent curved sidewall portion (102C).

In the embodiment shown, the fins (80) are integral with the cover plate (76) rather than being separate components attached to the plate. This avoids the need for a fin insert (e.g., an insert with fins inserted radially into an opening in the turret), thereby eliminating gaps between the fins and the upper wall (101) that can trap product and lead to bacterial growth and contamination. The orifices (79) through which purge gas is expelled are provided by the openings located between the upper wall (101), the upper surface (83) of the feed turret body, and a pair of adjacent fins (80) (or between an outermost fin (80A) and a sidewall portion (102C)) at the arcuate outer peripheral edge (105).

Because the fins (80) extend radially inward from the arcuate outer peripheral edge (105) that forms the pocket (P"), the distance between adjacent fins (80) decreases towards the outer peripheral edge such that the space between adjacent fins (80) (or between an outermost fin (80A) and the adjacent sidewall portion (102C)) is narrowest at the corresponding orifice (79). As a result, nozzles (85) of tapering width are provided between the upper wall (101) of the upper channel (98), the upper surface (83) of the feed turret body, and a pair of adjacent fins (80) (or between an outermost fin (80A) and a sidewall portion (102C)). The tapering width of the nozzles will cause the velocity of the purge gas to be increased further just before the purge gas is expelled from the orifices (79). The nozzles are also oriented such that the purge gas is expelled towards the center of a filled can positioned within the can pocket (P), as shown in FIG. 22. As a result, purge gas velocity across the headspace is increased, allowing for a reduction in the amount of purge gas needed to evacuate oxygen from the headspace immediately prior to seaming.

The feed turret (70) is mounted to the center hub (22) using the mounting bolts (81) received in the internally threaded blind holes (63) in the lower hub portion (26). The first time a center hub (22) is mounted to a seamer it will typically be necessary to adjust the center hub (22) for timing, to ensure the feed turret will be properly synched with the seamer turret (note that the seamer turret generally does not need adjustment for timing, since it is typically mounted on dowel pins). In that regard, one exemplary embodiment of a method for adjusting the timing of a center hub (22) will be described.

Initially, the center hub (22) may be mounted to the seamer feed turret hub (204) (see FIG. 40), and then one feed turret half (70A or 70B) is mounted thereto. The threaded fasteners inserted through the through holes (208) of the flange (205) of the seamer turret hub (204) into the threaded holes (56) of the center hub are loosened and the feed turret half is adjusted so that it is positioned 90° relative to the seamer turret. The through holes (208) are oversized with respect to the fasteners extending therethough into the threaded holes (56) of the center hub, thereby allowing for rotational adjustment of the center hub (22) for timing. Also in the embodiment shown, an elongate aperture (65) is provided in the center hub, extending into the lower hub portion (26) from the bottom surface (59) thereof.

When the center hub (22) is mounted on the seamer feed turret hub, elongate aperture (65) is aligned with aperture (210) in the flange (205) of the seamer feed turret hub (204), and an eccentric pin (not shown) will extend through aperture (210) into elongate aperture (65) for fine adjustment of timing. Once the center hub (22) has been aligned for timing with the seamer turret (such as, for instance, by locating a plug (e.g., a physical structure representing a can for use in the seamer) between adjacent arcuate pockets of the feed turret half and the seamer turret), the feed turret half can be removed.

Subsequently, feed turrets of varying sizes can be mounted to the aligned center hub without the need to remove the center hub or readjust for timing. Subsequent feed turret alignment and timing adjustment is not necessary, as the center hub (22) is aligned for proper timing and the center hub and feed turret are configured to be self-aligning with respect to one another (e.g., by precisely locating the feed turret halves (70A and 70B) relative to the center hub (22), such as by securing alignment pins (60) in through holes (73) (see FIG. 18B) of the feed turret in and/or by engaging mounting bolts (81) with slots (375) (see FIGS. 40-43)).

As noted above, a can seaming lines, such as the can seaming line (16) show in FIG. 1, also typically include a discharge turret assembly (120) for receiving seamed cans from the seamer turret (12) and directing the seamed cans to further processing and/or packaging. An exemplary embodiment of a discharge turret assembly (120) will now be described with respect to FIGS. 25-34.

Figure 27:
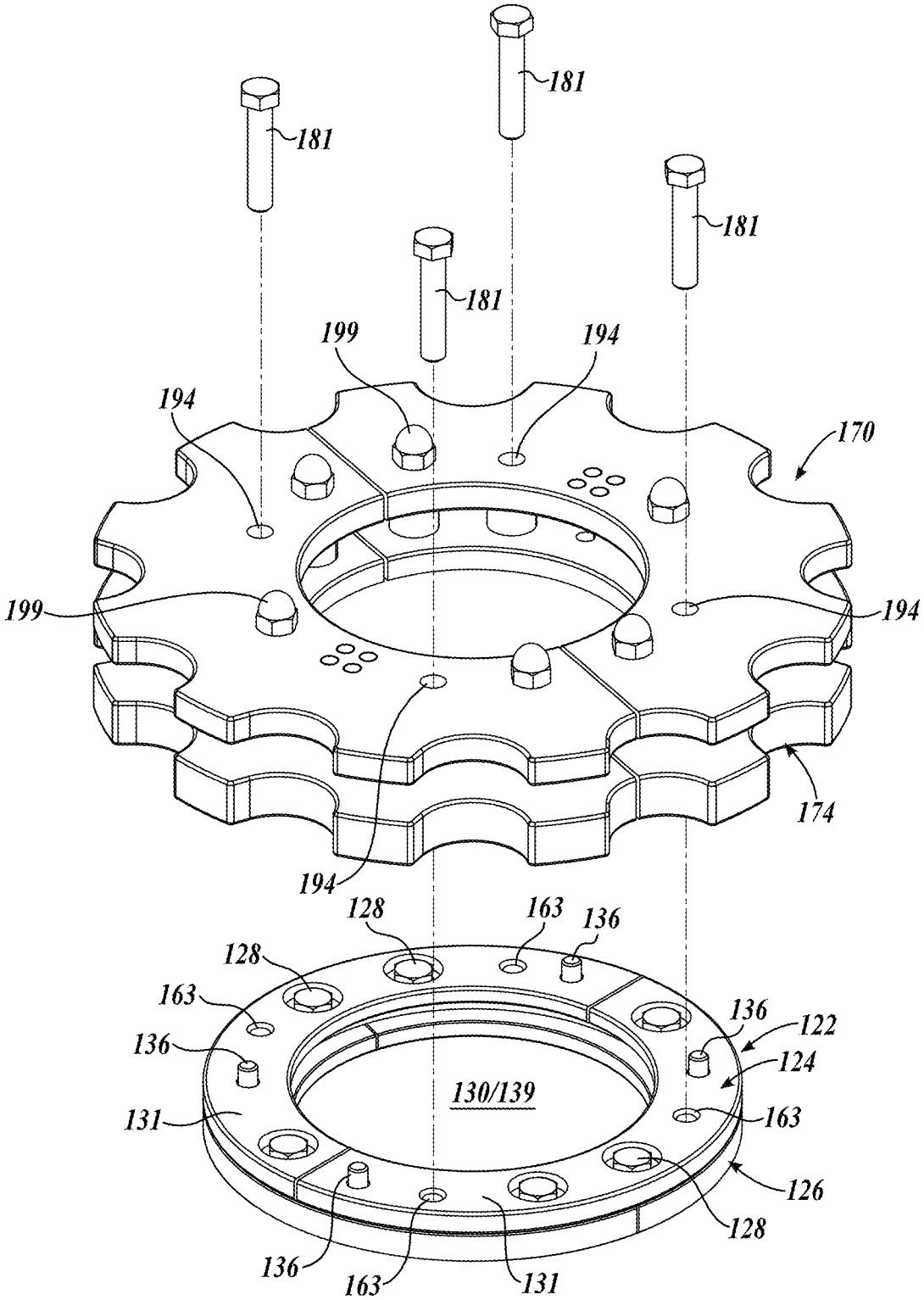
FIG. 27 is a partially exploded isometric view of the discharge turret assembly of FIG. 25.

In the exemplary embodiment depicted, discharge turret assembly (120) includes an annular base (or hub) (122), and an annular discharge turret (170) mountable thereto (see FIG. 27). Discharge turret assembly (120) is adapted to be mounted to a can seamer for rotation about rotational axis (B) of the discharge turret assembly. Discharge turret assembly (120) includes a plurality of arcuate can pockets (Q) arrayed about the outer periphery of the discharge turret assembly. In this example, 12 can pockets (Q) are provided. It will be understood, however, that the discharge turret assembly can be configured to have any of a variety of number of can pockets, depending, in part, on the size of the cans being filled.

The annular base (122) of the discharge turret assembly (120) is adapted to be mounted to the can seamer for driven rotation (by the seamer). Both the base (122) and the discharge turret (170) are annular in shape. The discharge turret (170) is mounted over the annular base (122) such that the hub is received within an annular recess (or chamber) (172) located on the underside of the discharge turret (170) (see FIG. 29A). The annular recess (172) is defined by an annular upper wall (172A), and outer wall (172B) that extends orthogonally away from the upper wall (172A) and defines the outer circumference of the annular recess (172) (see FIG. 29A). When the discharge turret (170) is mounted to the annular hub, an upper portion of the annular base is received within the annular recess (172) such that the upper surface (131) of the annular base (122) abuts against the upper wall (172A) (see FIGS. 33 and 34).

As with the feed turret assembly, in some embodiments it is not necessary to remove the annular base (122) from the can seamer to change the discharge turret assembly (120) to seal different sizes and/or configurations of cans. Instead, only the discharge turret (170) portion of the assembly (120) need be changed. Thus, annular base (122) can be used with two or more different discharge turrets (270) to accommodate different sizes of cans. Since discharge turret assembly timing is adjusted by the positioning of the annular base (122), this feature facilitates changeover to a new can size.

Once the annular base (122) has been mounted to the can seamer and adjusted for timing, a size changeover only requires mounting of a different discharge turret (170) to the annular base (122).

Accordingly, embodiments of the present disclosure include discharge turret systems comprising two or more discharge turrets (170) having different sizes, numbers or configurations of arcuate pockets (Q), and a common annular base (or hub) (122) that will accommodate the two or more different discharge turrets (170). For example, a first discharge turret is configured to be used for seaming cans of a first diameter and/or height, and a second discharge turret is configured to be used for seaming cans of a second diameter and/or height. The discharge turrets can be exchanged on the can seamer without first removing the annular base (or hub) (122).

Figure 28:
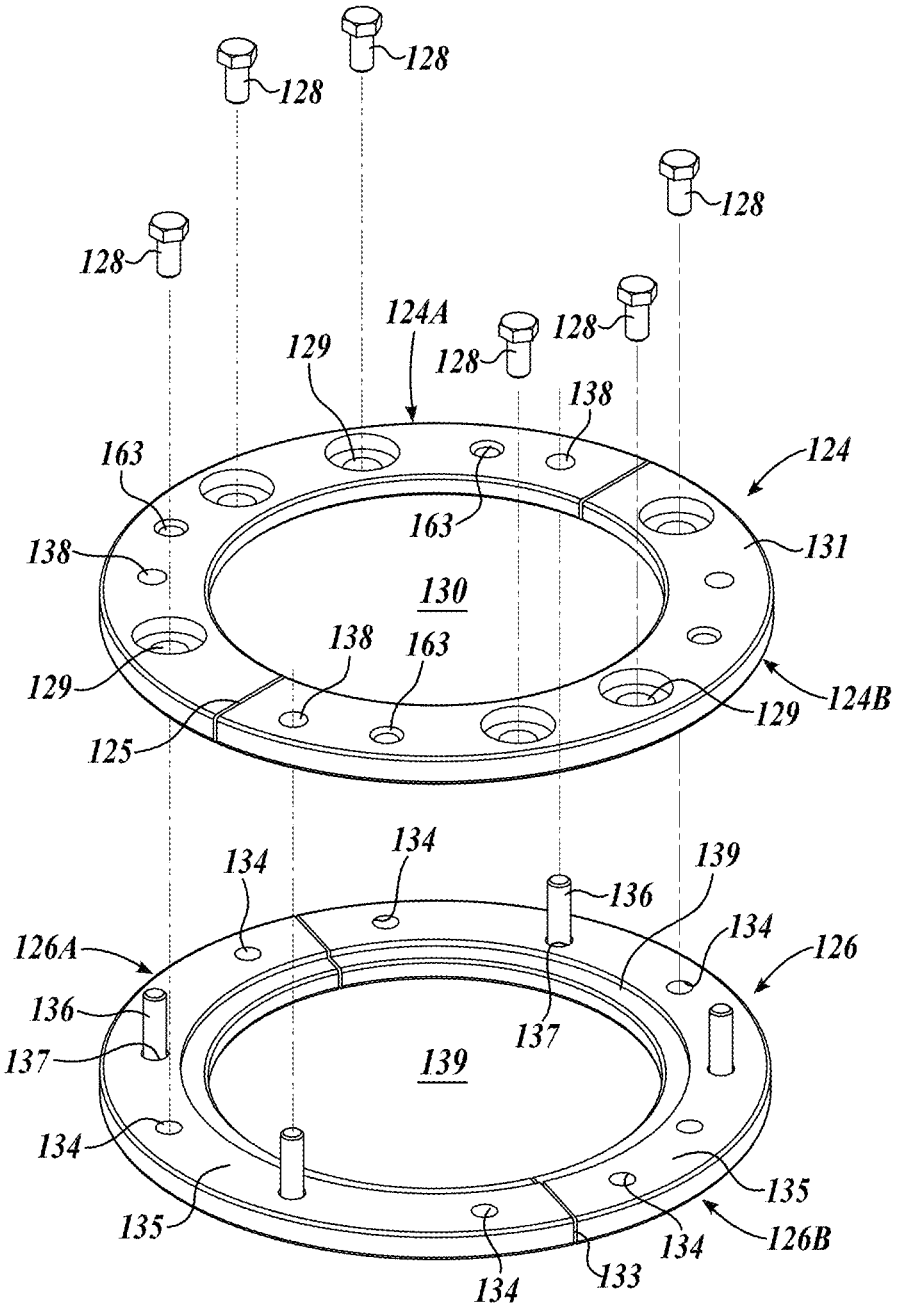
FIG. 28 is an exploded isometric view, from above, of the annular base (or hub) of the discharge turret assembly of FIG. 25.

Looking first at the annular base (or hub) (122), and as best seen in FIGS. 27 and 28, the annular base (122) generally comprises an upper base plate (124) mounted to a lower base plate (126). In the example shown, each base plate is bifurcated into two substantially identical or identical halves (hereinafter simply "identical halves"). Thus, upper base plate (124) includes two identical semi-annular halves (124A, 124B), and lower base plate (126) includes two identical semi-annular halves (126A, 126B). Bifurcating the base plates facilitates the handling and assembly of the plates, particularly when larger discharge turret assemblies are employed (i.e., the weight of each portion of the base that is handled is reduced by 50%). Of course, it will be understood that unitary (one-piece) base plates may be employed, particularly for smaller discharge turret assemblies. Likewise, each base plate also can include more than two semi-annular plates that, when mounted together, form annular base plate assemblies.

The upper base plate (124) is mounted to the lower base plate (126) using a plurality of fasteners, such as in the form of threaded bolts (128). Through holes (129) are arrayed around the central opening (130) of the upper base plate (124), and extend through the thickness of the upper hub plate (from upper surface (131) to the bottom surface of the upper base plate (not shown)). Counterbores are also provided in the upper surface (131) of the upper base plate (124) surrounding the through holes (129). The bolts (128) are threadingly received within threaded blind holes (134) in the upper surface (135) of the lower plate (126) (see FIG. 28). The blind holes (134) extend orthogonally from the upper surface (135) towards the bottom surface of the lower plate (126).

In the embodiment shown, six bolts (128) are used to secure the upper base plate (124) to the lower base plate (124), with three bolts for each half plate. It will be understood, however, that any number and arrangement of two or more bolts for each plate can be employed. Also, the bifurcated upper base plate (124) is mounted to the bifurcated lower base plate (126) such that the juncture (125) between the first and second upper base plate halves (124A, 124B) is rotationally offset from the juncture (133) between the first and second lower base plate halves (126A, 126B). This rotational offset can be, for example, between about 35 and about 90 degrees.

To aid in the assembly and alignment of the annular base, one or more alignment pins (136) extend between the upper and lower base plates (124, 126) within apertures therein. In the embodiment shown, four alignment pins (136) are threadably secured within internally threaded holes (137) extending orthogonally from the upper surface (135) towards the bottom surface of the lower plate (126). Corresponding through holes (138) are provided in the upper plate (124) for slidably receiving the alignment pins (136). Through holes (138) are used for receiving the alignment pins (136) so that the pins can be seen from above during assembly. The holes (138) for receiving the alignment pins (136) are positioned between the through holes (129).

It will be understood that any number of alignment pins (136) and corresponding holes may be provided. In the embodiment shown, the alignment pins (136) are sufficiently long so that, when the upper base plate (124) is mounted to the lower base plate (126), the pins (136) extend above the upper surface (135) of the upper base plate (see FIG. 27). This allows the alignment pins (136) to be received within through holes (173) in the lower discharge turret plate (174) so as to aid in the alignment and mounting of the discharge turret (170) to the base (122).

Internally threaded through holes (163) are also provided in the upper base plate (124) (see FIG. 28). In the embodiment shown, four threaded holes (163) are provided, two for each half plate (124A, 124B), symmetrically arrayed about central opening (130). As further described herein, threaded holes (163) are used to secure the discharge turret (170) to the annular base (122) (e.g., using threaded bolts).

Figure 36:
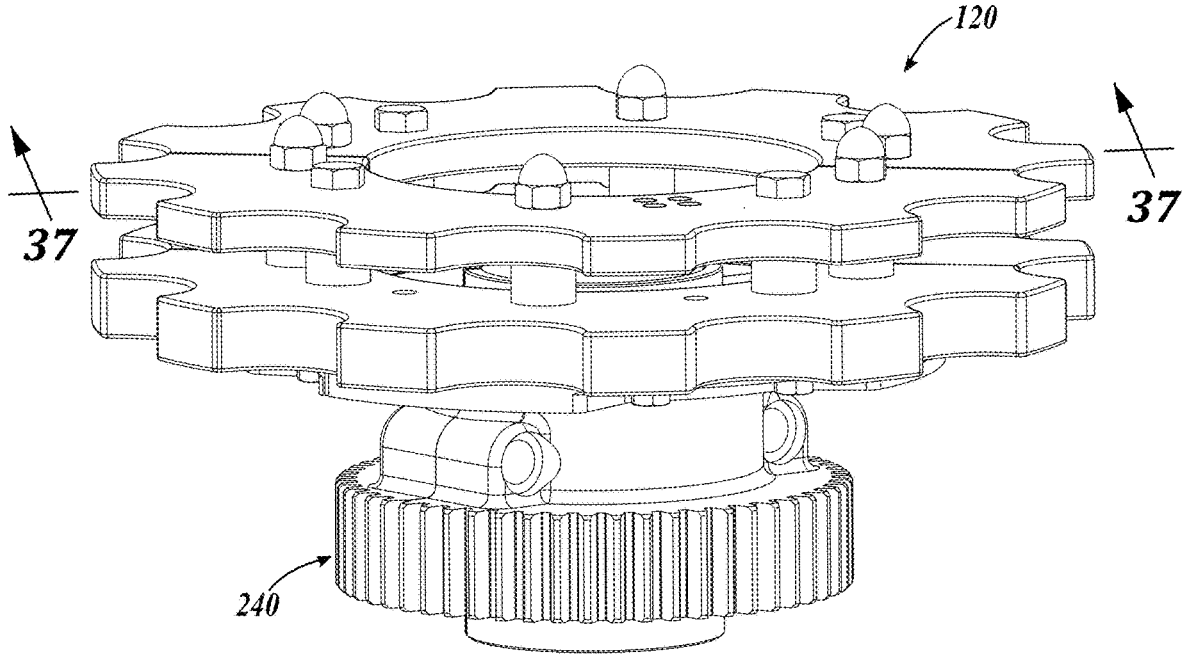
FIG. 36 depicts the discharge turret assembly of FIG. 26 mounted to the discharge spur gear of a seamer.
Figure 37:
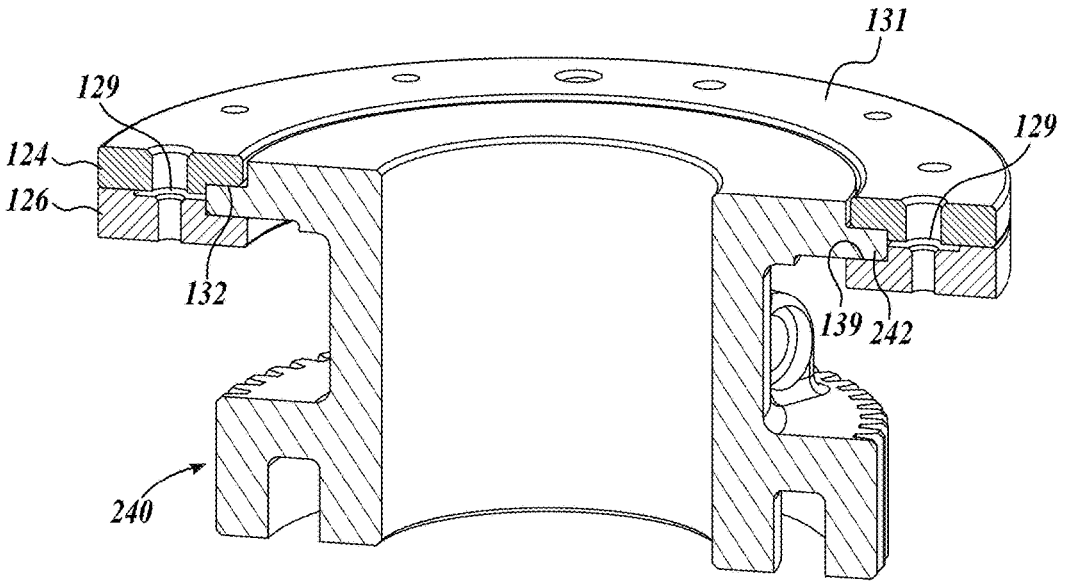
FIG. 37 is a cross-sectional view of FIG. 36, with the discharge turret omitted, taken along the line 37-37 thereof.

As shown in FIGS. 36 and 37, discharge turret assembly is adapted to be mounted to the discharge spur gear (240) of a seamer. Central opening (130) of upper plate (124) and central opening (139) of lower plate (126) have the same diameter and receive the flange of the discharge spur gear (240) of the can seamer therebetween. Specifically, an annular recess (139) is located in the upper surface of the lower base plate (126), extending about the central opening (139) thereof (see FIG. 28). An identical annular recess (132) is located in the bottom surface of the upper base plate (124), extending about the central opening (130) thereof (see FIG. 34).

When the upper and lower base plates (124, 126) are secured to one another, a flange receiving space (140) is provided between the annular recesses (132, 139) of the upper and lower base plates (124, 126). As seen in the cross-sectional view of FIG. 37, the upper and lower base plates (124, 126) are mounted to the discharge spur gear (240) such that the flange of the spur gear is received within the flange receiving space (140) between the annular recesses (132, 139) of the upper and lower base plates (124, 126).

Turning to the discharge turret (170), the discharge turret includes an annular lower discharge turret plate (174) and an annular upper discharge turret plate (176) secured thereto. As with the base plate, the lower and upper discharge turret plates (174, 176) are configured as two substantially identical or identical halves (as first and second halves) due to the size and weight of the discharge turret. By providing the discharge turret plates as two substantially identical or halves (hereinafter simply "identical halves"), assembly and handling of the discharge turret is facilitated. However, it will be understood that the discharge turret plates can be configured as single annular structures (i.e., one lower discharge plate and one upper discharge plate), particularly for smaller discharge turrets.

Figure 29A:
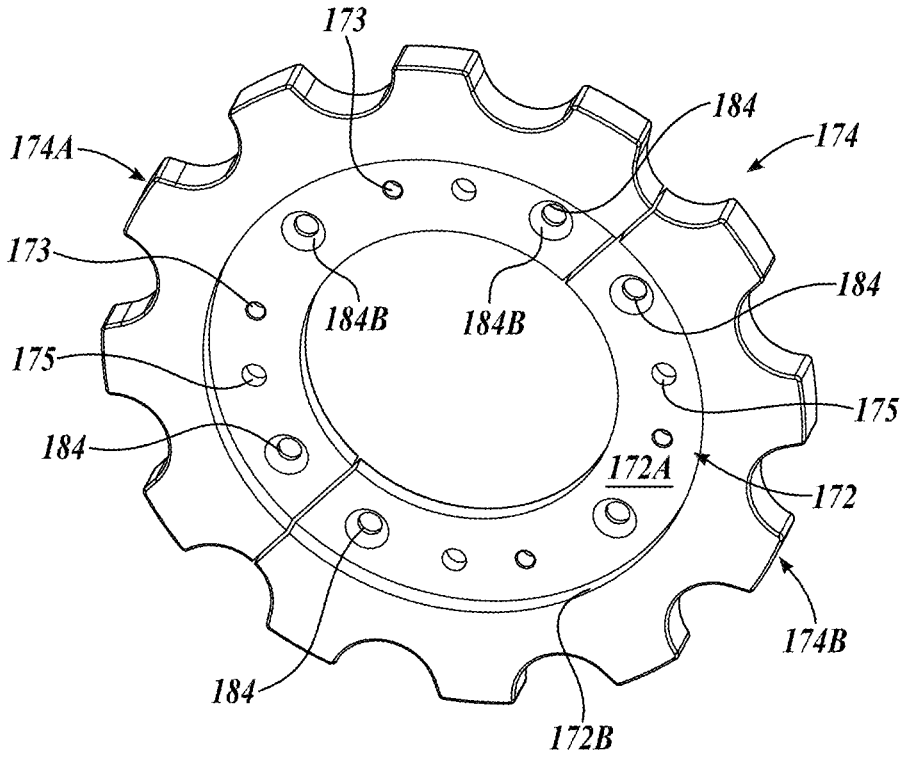
FIGS. 29A-29B are isometric views of the bottom turret plate of the discharge turret assembly of FIG. 25.
Figure 29B:
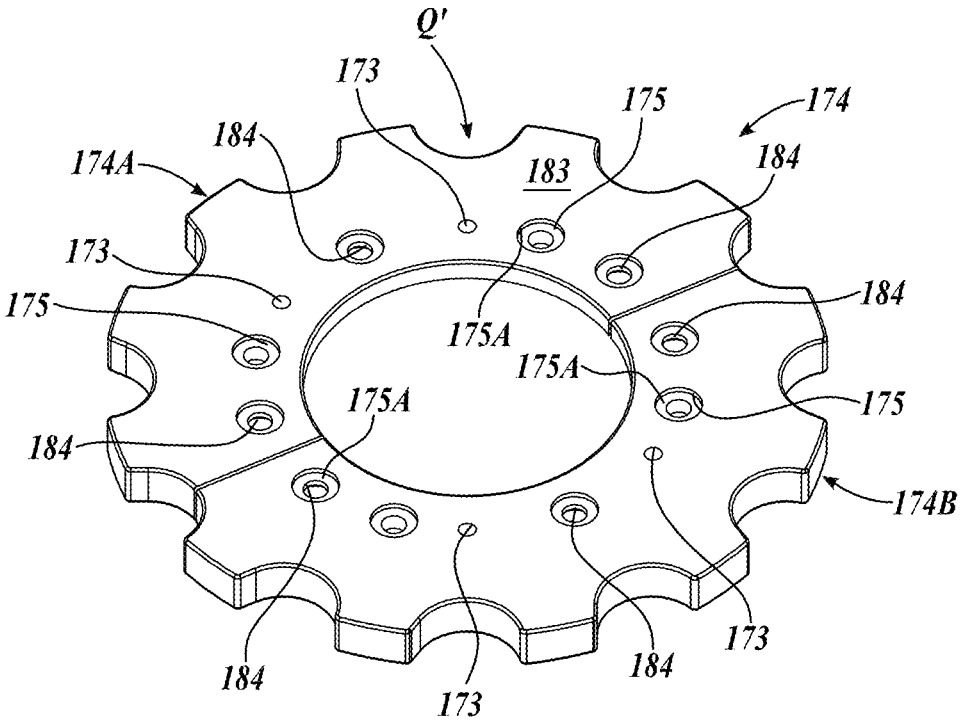

Lower discharge turret plate (174) includes a bifurcated annular plate formed of a first lower discharge turret plate (174A) and a second lower discharge turret plate (174B) (see FIGS. 29A-B). A plurality of arcuate can pockets (Q') are arrayed about the outer periphery of the lower discharge turret plate (174) and form the lower portion of the can pockets (Q) when the discharge turret is assembled. The upper surface (183) of the lower discharge turret plate is flat (i.e., orthogonal to the rotational axis B). The annular recess (172) described above is located in the bottom (or underside) of the upper discharge turret plate (174). Through holes (173) extend through the upper wall (172A) of recess (172) and the upper surface (183) of the lower discharge turret plate and are adapted to receive the alignment pins (136) of the base (122) ((such as for precisely locating any discharge turret relative to the base (122) after the base is initially adjusted for timing)).

Figure 35:
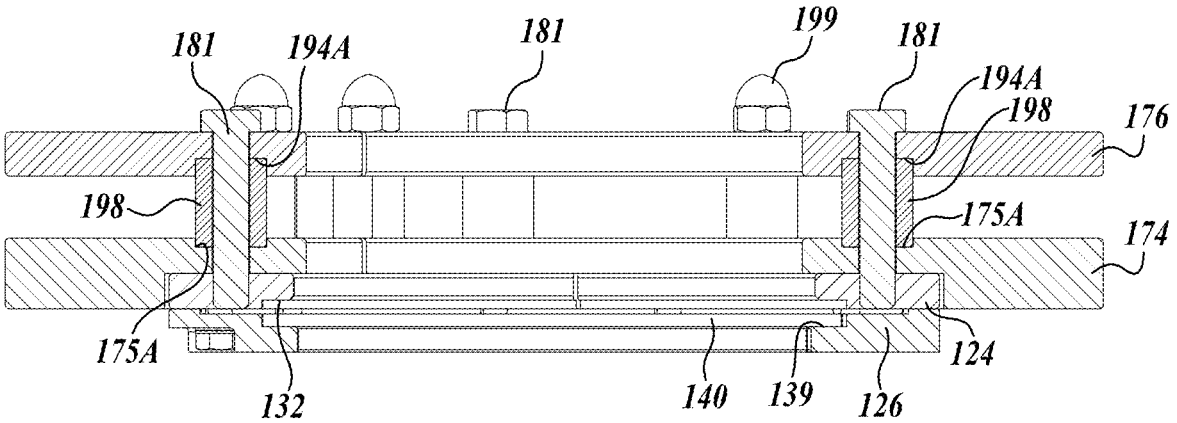
FIG. 35 is a cross-sectional view of the discharge turret assembly of FIG. 26, taken along the line 35-35 thereof.

An additional set of through holes (175) are also provided in lower discharge turret plate (174), with two such holes (175) provided in each of the first and second feed lower discharge plate halves (174A, 174B). Similar through holes 194 are provided in each of the first and second feed upper discharge plate halves (176A, 176B). The through holes (175, 194) are arranged such that, when the lower and upper discharge plate feed turret bodies (174, 176) are mounted to the base (122), the through holes (175, 194) are aligned with the internally threaded blind holes (163) in the upper base plate (124). Threaded bolts (181) are used to secure the discharge turret (170) to the base (122), as best seen in FIG. 35. It will be understood that any number of threaded bolts (181) or other fasteners and corresponding holes may be provided for securing the discharge turret (170) to the base (122).

A third set of through holes (184) extend orthogonally from the upper surface (183) of the lower discharge turret plate (174) to the bottom surface of the lower discharge turret plate. In the embodiment shown, the third set of through holes (184) are used in securing the upper discharge turret plate (176) to the lower discharge turret plate (174), with spacers (187, 198) located between the upper and lower discharge turret plates (174, 176) such that the discharge turret plates are uniformly spaced from one another (as described below).

Figure 30A:
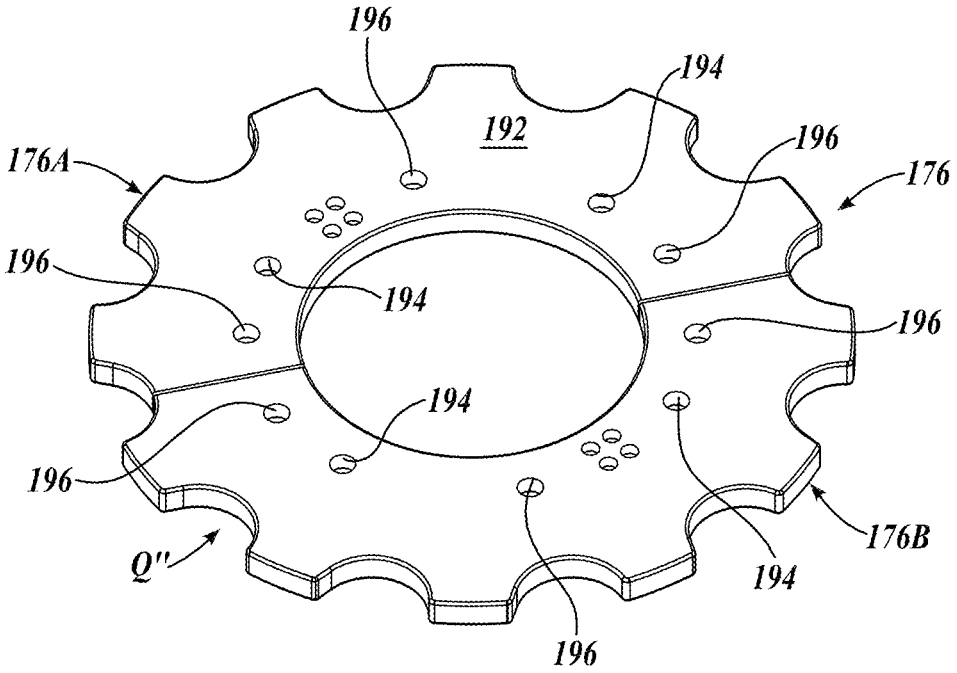
FIGS. 30A-30B are isometric views of the bottom turret plate of the discharge turret assembly of FIG. 25.
Figure 30B:
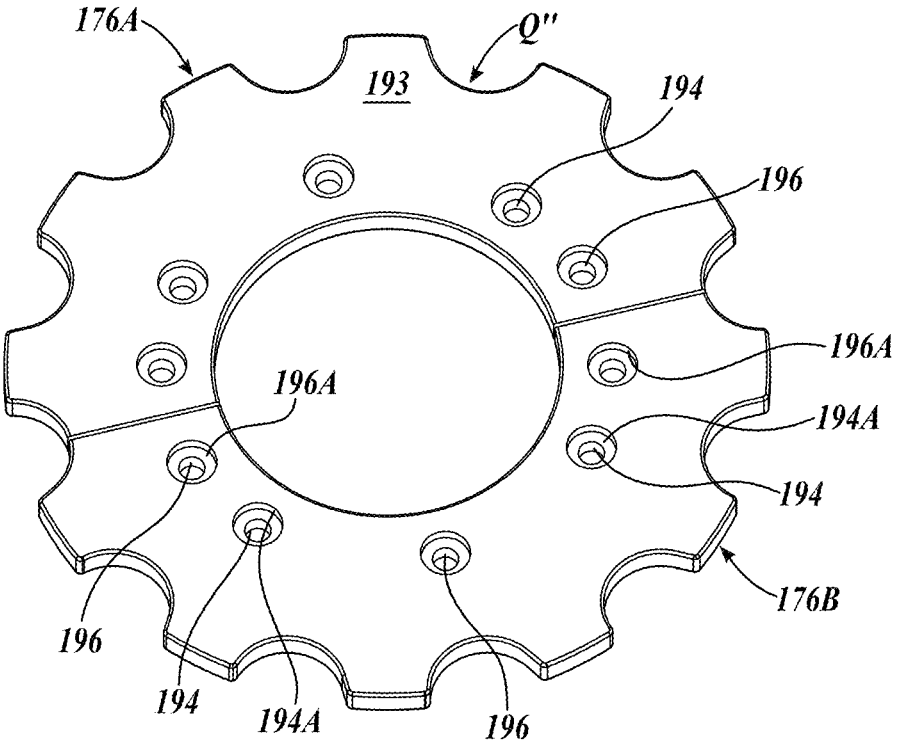

Upper discharge turret plate (176) also includes a bifurcated annular plate formed of a first upper discharge turret plate (176A) and a second upper discharge turret plate (176B) (see FIGS. 30A-B). A plurality of arcuate can pockets (Q") are arrayed about the outer periphery of the upper discharge turret plate (176), and form the upper portion of the can pockets (Q) when the discharge turret is assembled. The upper and bottom surfaces (192, 193) of the lower discharge turret plate are flat (i.e., orthogonal to the rotational axis B).

Through holes (194) are also provided in upper discharge turret plate (176), with two such holes (194) provided in each of the first and second feed upper discharge plate halves (176A, 176B). The through holes (194) are arranged such that, when the lower and upper discharge turret plates (174, 176) are mounted to the base (122), the through holes (194) are aligned with the through holes (175) in the lower discharge turret plate as well as the internally threaded blind holes (163) in the upper base plate (124). The threaded bolts (181) can then be used to secure the discharge turret assembly (170) to the base (122), as best seen in FIGS. 27 and 35.

A second set of through holes (196) extend orthogonally from the upper surface (192) of the upper discharge turret plate (176) to the bottom surface (193) of the upper discharge turret plate. The through holes (196) are arranged such that, when the lower and upper discharge turret plates (174, 176) are assembled to one another, the through holes (196) are substantially aligned with the through holes (184) in the lower discharge turret plate.

As mentioned above, spacers (187, 198) are located between the upper and lower discharge turret plates (174, 176) of the discharge turret assembly (170) such that the discharge turret plates are substantially uniformly spaced from one another. In the embodiment shown, two sets of spacers are employed. Spacers (198) are embodied as hollow cylinders, and they are positioned such that the hollow bore (198A) of each spacer is aligned with a pair of the through holes (175, 194) in the lower and upper discharge turret plates as well as one of the internally threaded blind holes (163) in the upper base plate (124). The threaded bolts (181) are then passed therethrough and threadingly secured within the internally threaded blind holes (163) in the upper base plate (124) (see FIG. 35).

Figure 31A:
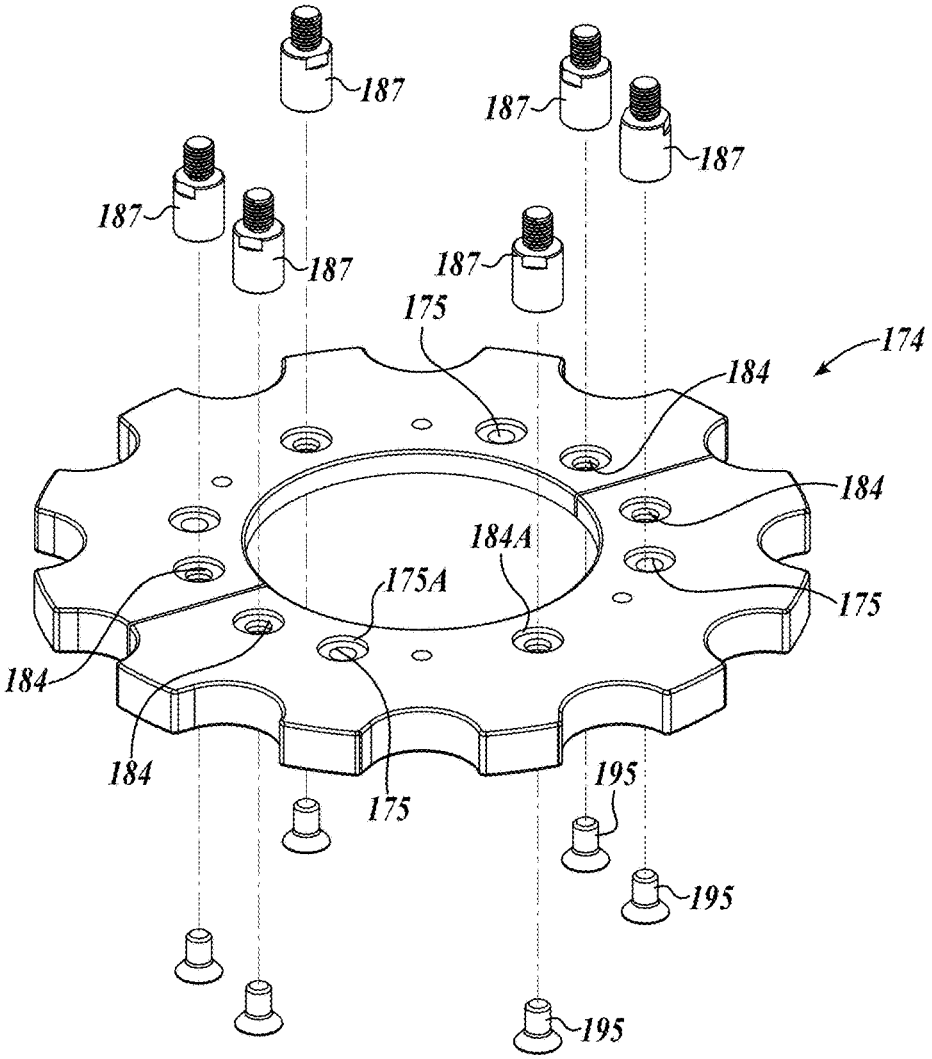
FIG. 31A is an exploded isometric view of the bottom turret plate of the discharge turret assembly of FIG. 25, viewed from above, with a first portion of the turret plate spacers and the threaded studs shown.
Figure 31B:
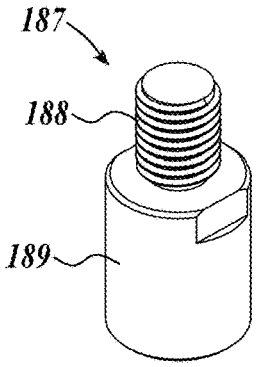
FIG. 31B is an isometric view of a threaded stud spacer used in the discharge turret assembly of FIG. 25.
Figure 31C:
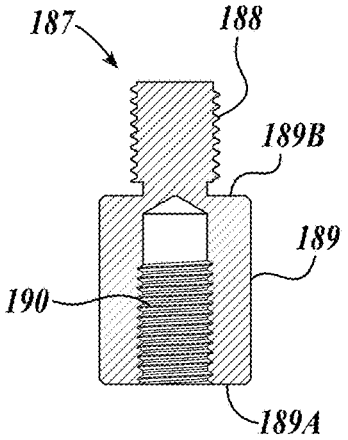
FIG. 31C is a cross-sectional view of the threaded stud spacer of FIG. 31B.
Figure 31D:
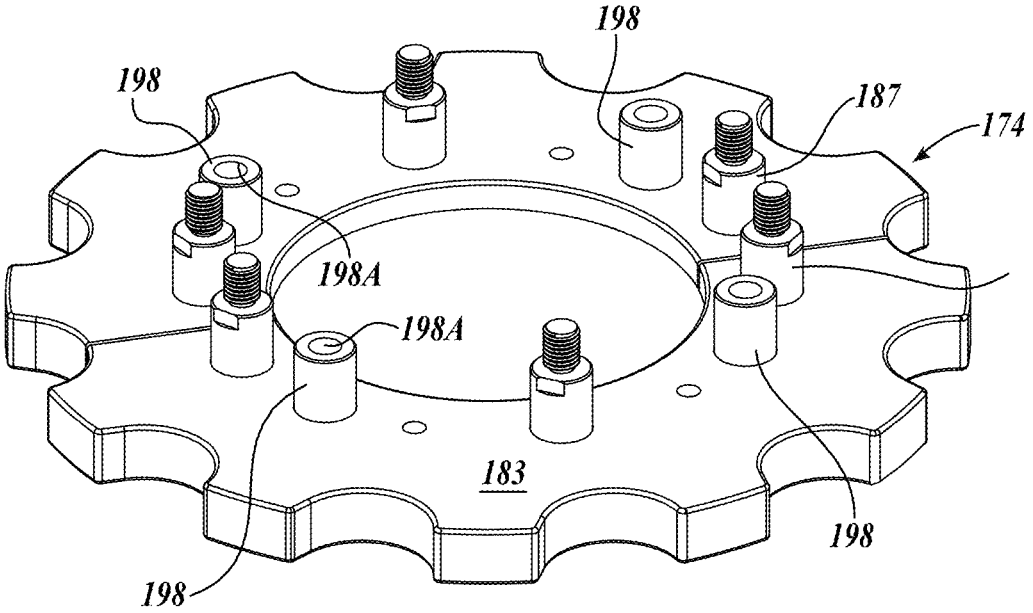
FIG. 31D is the same view as FIG. 31A, but with the first and second portions of turret spacers and threaded stud spacers in place.

To aid in the assembly of the discharge turret (170), including alignment of the spacers (198), the depicted embodiment includes shallow cylindrical cavities (or countersinks) for receiving end portions of the spacers. In particular, cylindrical cavities (175A) are provided in the upper surface (183) of the lower discharge turret plate, surrounding the through holes (175), as best seen in FIGS. 29B and 31A. Each of the cavities (175A) is sized and configured to receive a lower end portion of a spacer (198), as best seen in FIGS. 31D and 35. Similarly, cylindrical cavities (194A) are provided in the bottom surface of the upper discharge turret plate, surrounding the through holes (194), as best seen in FIG. 30B. Each of the cavities (194A) is sized and configured to receive an upper end portion of a spacer (198), as best seen in FIG. 35.

In addition to spacers (198), the depicted embodiment also includes threaded stud spacers (187) located between the upper and lower discharge turret plates (174, 176) of the discharge turret assembly (170). As shown in FIGS. 31B and 31C, threaded stud spacers (187) include a cylindrical body (189) having a size and shape similar (or identical to) the spacers (198). The cylindrical body (189) of threaded stud spacers (187) further includes an internal threaded bore (190) extending from the bottom end wall (189A) of the body (189). A threaded stud (188) extends away from the upper end wall (189B) of the cylindrical body (189).

Figure 33:
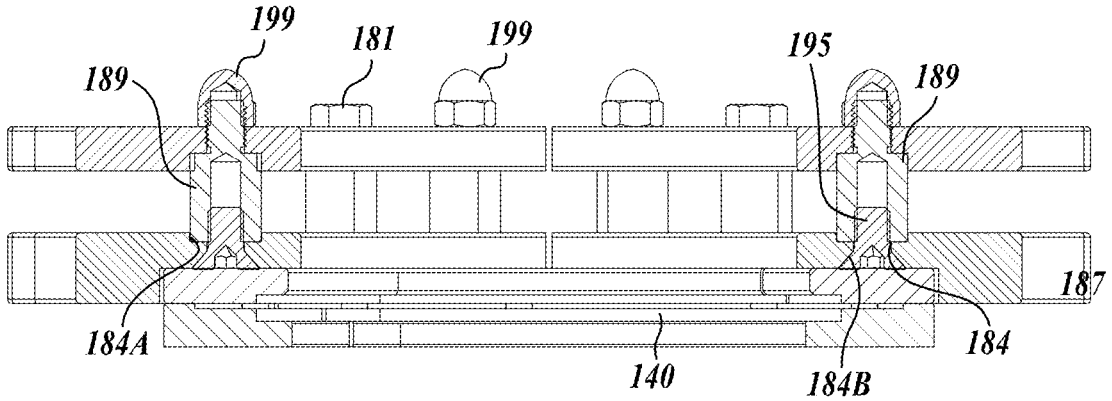
FIG. 33 is a cross-sectional view of the discharge turret assembly of FIG. 26, taken along the line 33-33 thereof.
Figure 34:
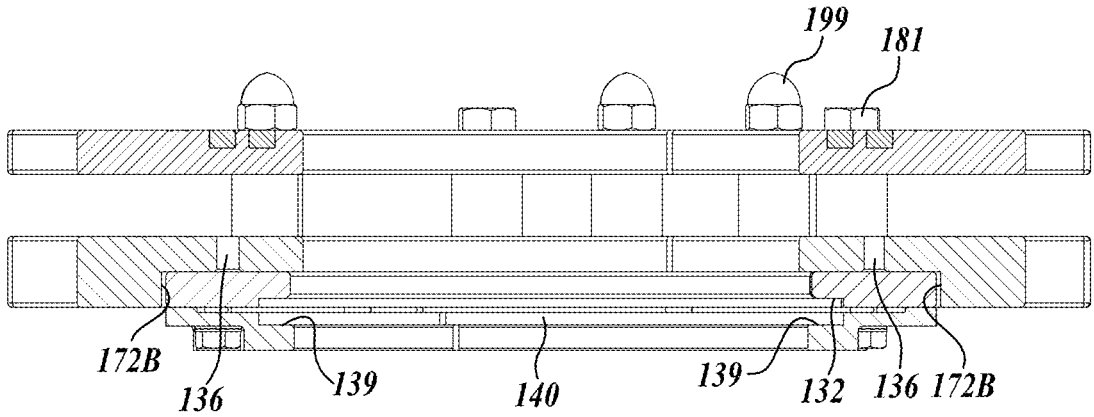
FIG. 34 is a cross-sectional view of the discharge turret assembly of FIG. 26, taken along the line 34-34 thereof.

The bottom wall end wall (189A) of each threaded stud spacer (187) is positioned against the upper surface (183) of the lower discharge turret plate, with the internal threaded bore (190) axially aligned with a through hole (184) in the lower discharge turret plate. In the depicted embodiment, cylindrical cavities (or countersinks) (184A) are provided in the upper surface (183) of the lower discharge turret plate, surrounding the through holes (184), with each of the cavities (184A) sized and configured to receive a lower end portion of the cylindrical body (189) of a threaded stud spacer (198), as best seen in FIGS. 31A and 33.

On the underside of the lower discharge turret plate (174), conical countersinks (i.e., cavities) (184B) are provided in the upper wall (172A) of the annular recess (172). With the lower end portion of the cylindrical body (189) of a threaded stud spacer (198) positioned within a cavity (184A) in the upper surface of the lower discharge turret plate, a threaded fastener (195) (e.g., a machine screw) is inserted through the through hole (184) from the underside of the lower discharge turret plate and threadably secured within the internally threaded bore (190) of the stud spacer (see FIG. 33). This secures the threaded stud spacers (198) to the lower discharge turret plate (174).

Cylindrical cavities (or countersinks) (196A) are similarly provided in the bottom surface (194) of the upper discharge turret plate, surrounding the through holes (196), as best seen in FIG. 30B. Each of the cavities (196A) is sized and configured to receive an upper end portion of the cylindrical body (189) of a threaded stud spacer (198), with the threaded stud portion (188) of the threaded stud spacer extending through the through hole (196), as best seen in FIGS. 32 and 33.

Figure 32:
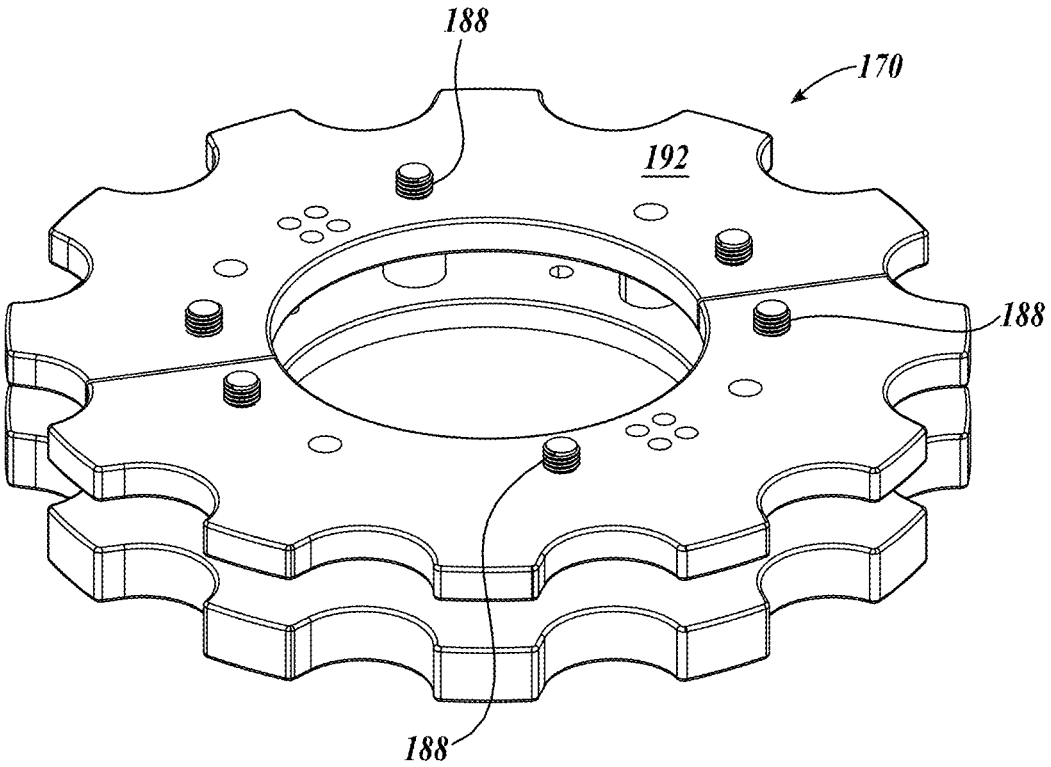
FIG. 32 is the same view as FIG. 31, with the top turret plate mounted to the bottom turret plate, with the acorn nuts omitted.

During assembly of the discharge turret (170), with the threaded stud spacers (198) to the lower discharge turret plate (174), the upper discharge turret plate (176) may be positioned over the lower plate (174) such that the upper end portions of the spacers (198) are received within the cavities (194A) and the upper end portions of the cylindrical bodies (189) of the threaded stud spacers (198) are received within the cavities (196A) of the upper plate, with the threaded stud portions (188) of the threaded stud spacers extending through the through holes (196) and protruding beyond the upper surface (192) of the upper plate (see FIG. 32). Threaded nuts, such as acorn nuts (199) (see FIG. 25), and then used to secure the upper and lower discharge turret plates (176, 174).

Threaded bolts (181) are used to secure the discharge turret (170) to the base (122), while the nuts (199) and associated threaded stud spacers (187) are used to secure the upper and lower discharge turret plates (176, 174) to one another. When it is necessary to replace a discharge turret (170) on a seamer (e.g., when switching can sizes), it is only necessary to replace the discharge turret (170). The base (122) can remain on the can seamer. Thus, once the base (122) is mounted to the can seamer and adjusted for timing, replacing the discharge turret (170) does not require removal or even readjusting (e.g., for timing) of the base. Instead, only the discharge turret (170) need be replaced, by loosening and removing bolts (181).

In the particular embodiment shown, acorn nuts (199) are used in securing the upper and lower discharge turret plates (176, 174) to one another instead of hex or square nuts so as to distinguish the acorn nuts (199) from the heads of the threaded bolts (181). This serves as a visual indicator or reminder that the accord nuts (199) do not need to be removed when replacing a discharge turret (170)—only the threaded bolts (181).

Figure 38:
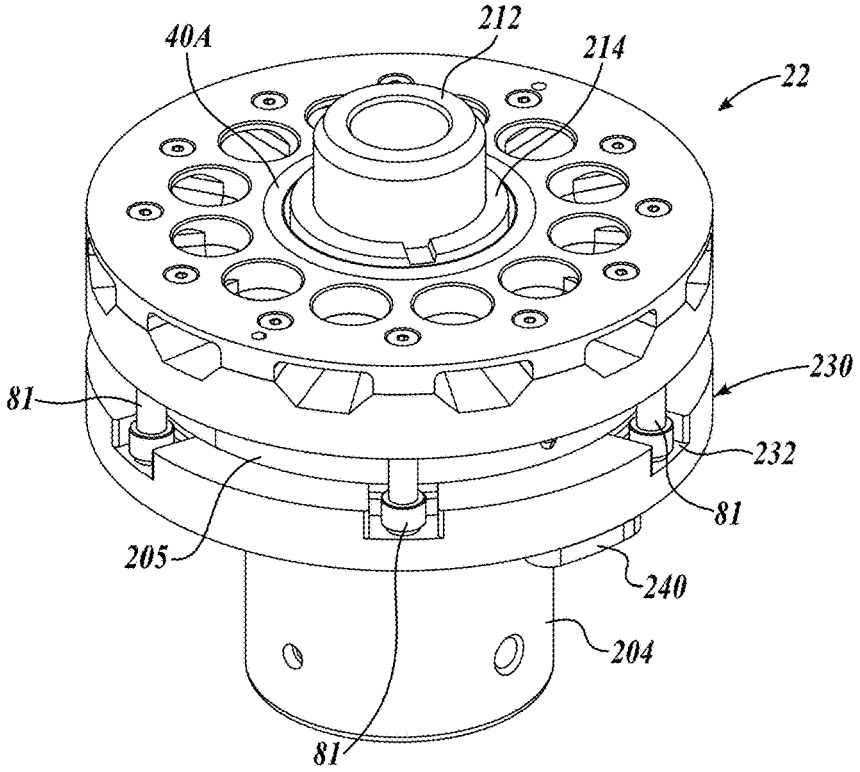
FIG. 38 depicts an alternative embodiment of a feed turret center hub, mounted to seamer turret hub using a changeover ring.
Figure 39:
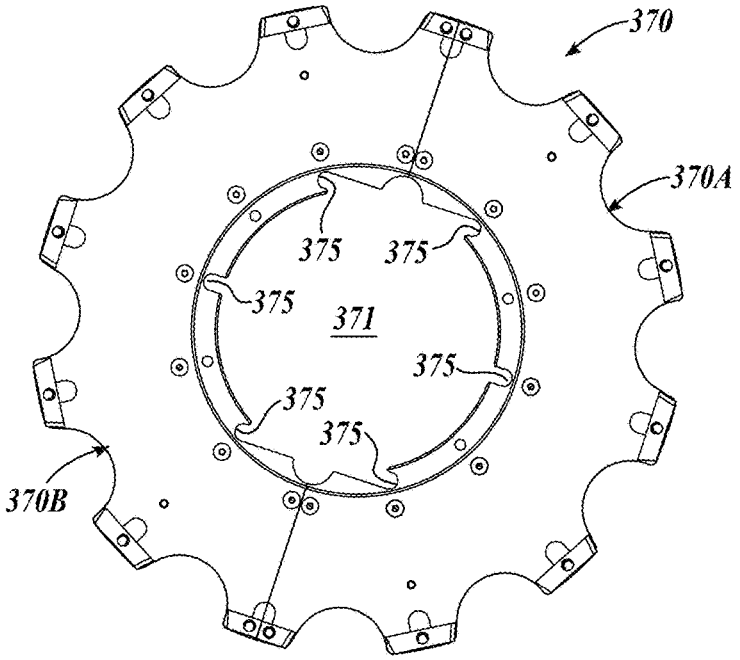
FIG. 39 is a top plan view of an alternative embodiment of a feed turret, with the center hub omitted, for use with the center hub of FIG. 38.

FIGS. 38-43 depict an alternative embodiment for the mounting of the feed turret assembly to the seamer. In this embodiment, a changeover ring (230) is mounted to the feed turret hub (204) of the seamer in order to facilitate mounting of the feed turret (370) to the center hub (22) after the center hub has been mounted to the feed turret hub. In this embodiment, the same center hub (22) the embodiment shown in FIGS. 2-24 is used. However, as best seen in FIG. 39, the through holes in the annular flange (372) of the feed turret have been replaced with slots (375) open to the annular chamber (371) of the feed turret (370). The outer ends of the slots (375) are arcuate, and are sized to receive the shafts of the threaded bolts (81) used to secure the feed turret (370) to the center hub (22). In the embodiment shown, the slots (375) in the flange of each feed turret half (370A, 370B) extend parallel to one another, as shown.

The annular changeover ring (230) is secured to the flange (205) of the feed turret hub (204), such that the changeover ring (230) extends about the periphery of the flange (205) with the upper surface (231) of the changeover ring (230) flush with the upper surface (206) of the flange (205). A plurality of cutouts (232) extend downwardly from the upper surface (231) of the changeover ring. The number and position of the cutouts (232) correspond to the number of threaded bolts (81) used to secure the feed turret (370) to the center hub (22). Moreover, the position of the cutouts (2321) correspond to that of the internally threaded blind holes (63) in the lower hub portion (26) (see FIG. 43).

Figure 40:
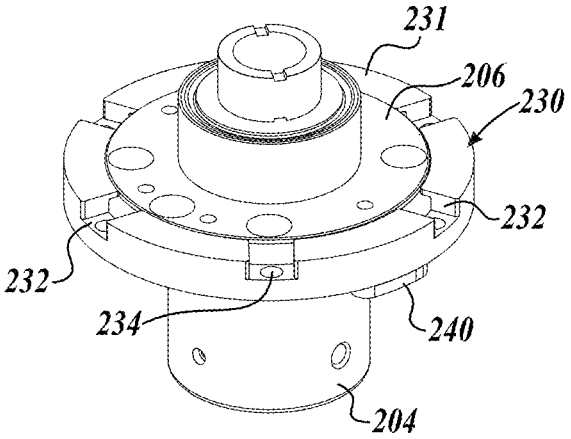
FIG. 40 depicts the changeover ring of FIG. 39 mounted to the seamer turret hub.
Figure 41:
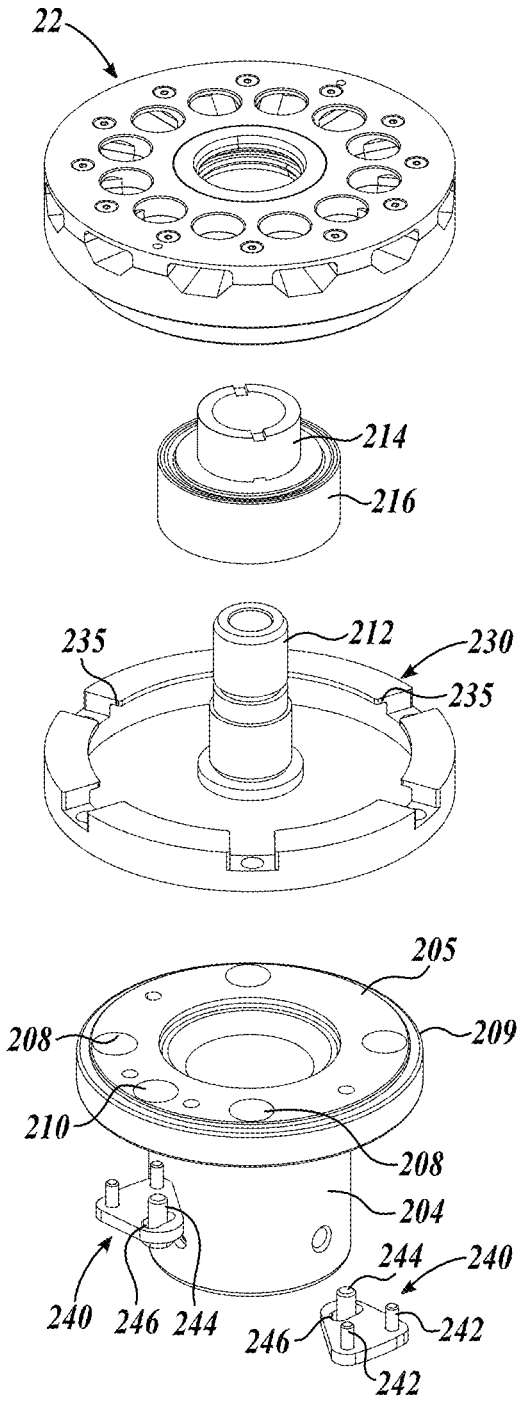
FIG. 41 is an exploded view of FIG. 38.

The changeover ring (230) includes an internal upper flange (235) extending radially inward and around the interior of the ring. The upper flange (235) is sized and configured to alignably mate with an outer recess (209) extending about the periphery of the flange (205) of the seamer feed turret hub (204). In this manner, the changeover ring (230) alignably fits over the periphery of the flange (205) of the seamer feed turret hub (204) (as best seen in FIG. 40).

Figure 42:
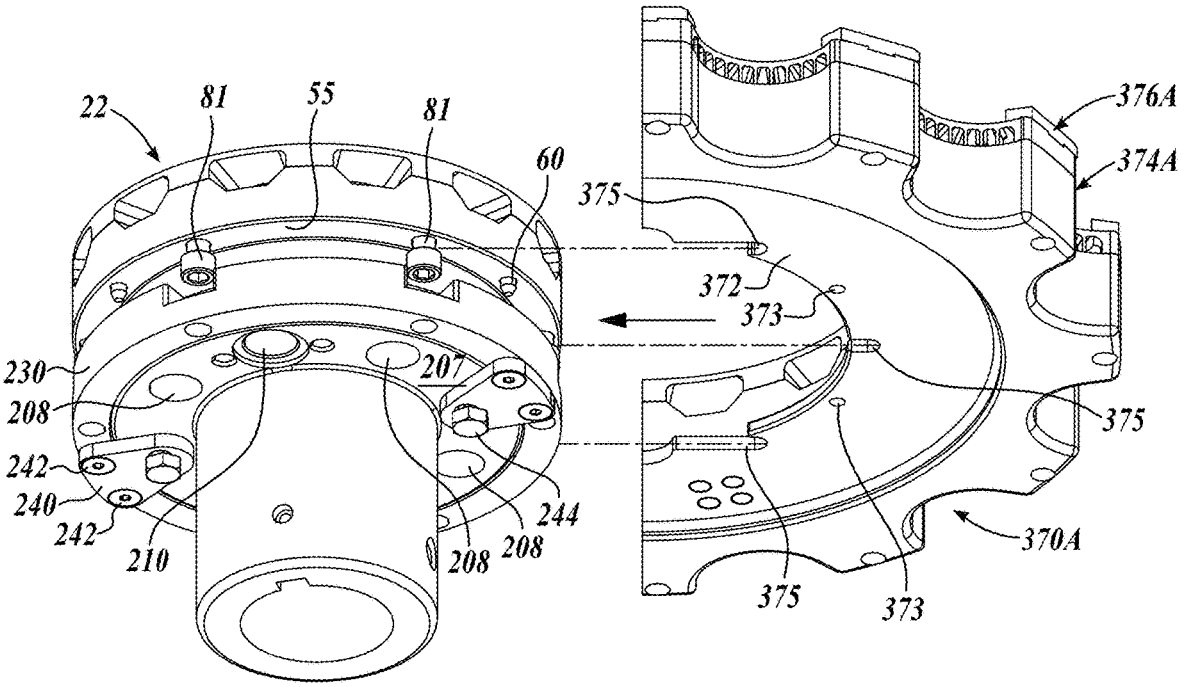
FIG. 42 depicts the mounting of a feed turret half to the center hub of FIG. 38, viewed from below.
Figure 43:
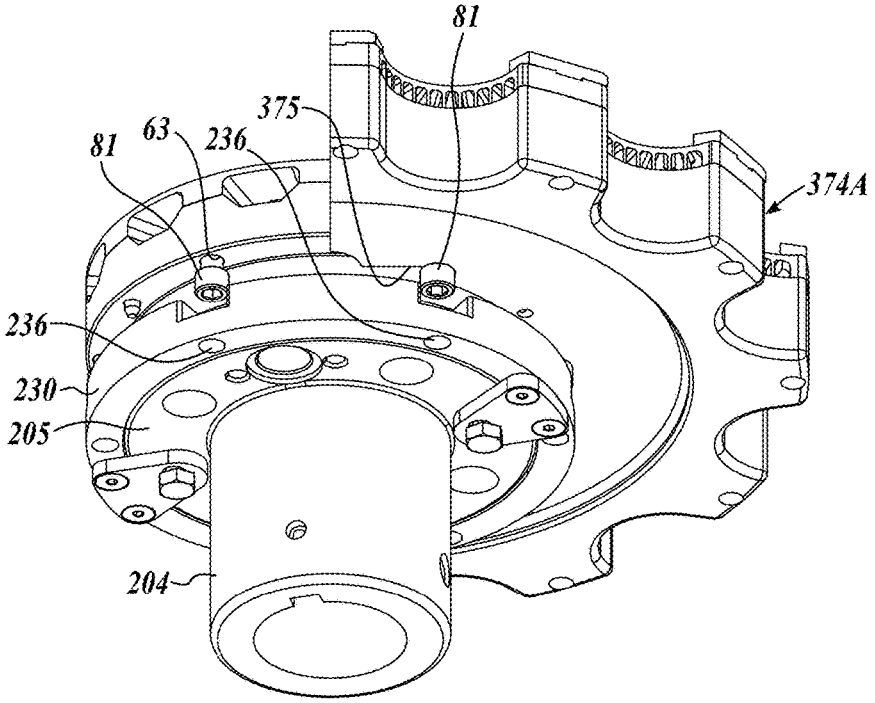
FIG. 43 is the same view as FIG. 42, with the feed turret half mounted to the center hub.

The changeover ring (230) can be secured to the flange (205) in a variety of ways. In the embodiment shown, a pair of tie plates (240) are provided for securing the changeover ring (230) to the bottom surface (207) of the flange, as best seen in FIGS. 42 and 43. A pair of threaded first fasteners (242) extend through the tie plate (240) into threaded bores in the bottom of the changeover ring. A threaded second fastener (244) extends through an elongate aperture (246) in the tie plate (240) into a threaded bore in the bottom of the flange (205) of the seamer feed turret hub (204). The elongate nature of the aperture (246) in the tie plate allows the position of the changeover ring (230) to be adjusted not only for timing purposes, but also to ensure that the cutouts (232) are aligned with the internally threaded blind holes (63) in the lower hub portion (26).

As seen in FIGS. 38, 42, and 43, center hub (22) can be mounted to flange (205) of the seamer turret hub (204) with the hub mounting bolts (81) partially inserted into the threaded holes (63) in the lower hub portion (26). The cutouts (232) in the changeover ring (230) are arranged such that the heads of the mounting bolts (81) will be located within the cutouts when the center hub is mounted to the flange (205) of the seamer turret hub (204). As a result, the mounting bolts (81) are captive, as best seen in FIG. 38, which facilitates attachment of the feed turret halves.

As best seen in FIGS. 42 and 43, a feed turret half (370A) is attached to the center hub (22) by sliding the flange (372) into the space between the bottom surface of the lower shoulder (55) of the center hub (22) and the upper surface (231) of the changeover ring (230) such that mounting bolts (81) enter the slots (375) until they reach the arcuate outer ends (or bottom) of the slots (375). At this point, the through holes (373) in the flange (372) will be aligned with the alignment pins (60) on the center hub (22). The mounting bolts (81) can then be secured within the holes (63) in the center hub, such as by using an Allen wrench (hex key) inserted through the access holes (236) in the changeover ring (see FIG. 43). The feed turret half (370A) is thereby secured to the center hub (22), mounted on the seamer. The other feed turret halve is then attached in the same manner.

It will be understood that the components of the feed turret assembly and discharge turret assembly can be manufactured in any of a variety of ways. In some particular embodiments, the components are machined from metal, particularly stainless steel. Machining allows for precise formation of the components, and avoids the need to inserts or other attachments to provide the various features of the components described herein. Machining is particularly beneficial for the structure of the gas flow chambers, as it can avoid the need for inserts and other attachments that often provide vertical walls and sharp edges that increase turbulence in the purge gas.

While various embodiments of replaceable turret assemblies for container seaming systems have been described in detail above, it will be understood that the components, features and configurations, as well as the methods of manufacturing the devices and methods described herein are not limited to the specific embodiments described herein.

The embodiments of the invention in which an exclusive property or privilege is claimed are defined as follows:

1. A first turret assembly for a container sealing system, comprising:

a hub adjustably and rotatably securable to the container sealing system such that a timing of the first turret assembly may be adjusted relative to a second turret assembly of the container sealing system;

an annular turret body having a plurality of arcuate container pockets arrayed about an outer periphery of the annular turret body, the annular turret body removably securable to the hub; and an alignment assembly configured to align the annular turret body on the hub such that the first turret assembly remains timed relative to the second turret assembly when the annular turret body is received on the hub.

2. The first turret assembly of claim 1, wherein the annular turret body includes a first turret body portion and a second turret body portion.

3. The first turret assembly of claim 1, further comprising a gas purge assembly configured to direct purge gas across a headspace between a container end and a surface of a product within a container located in one of the plurality of arcuate container pockets in order to purge air from the container immediately prior to sealing, wherein the gas purge assembly is configured to at least one of:

create a laminar flow of purge gas through the hub and the annular turret body;

direct purge gas upwardly as it flows radially through the hub and the annular turret body toward an orifice assembly in the arcuate container pocket; and decrease a velocity of purge gas as it exits an orifice assembly in the arcuate container pocket.

4. The first turret assembly of claim 3, wherein the gas purge assembly includes:

a plurality of gas purge inlets defined in the hub that are configured to receive purge gas from a purge gas supply;

a plurality of hub gas flow chambers defined in the hub, each in fluid communication with a corresponding gas purge inlet;

a plurality of turret gas flow chambers defined in the annual turret body, each in fluid communication with a corresponding hub flow chamber; and a plurality of purge gas orifices defined in each of the arcuate container pockets of the annular turret body, wherein each of the plurality of purge gas orifices is in fluid communication with a corresponding hub gas flow chamber.

5. The first turret assembly of claim 4, wherein a cross-sectional area of each turret gas flow chamber increases as the purge gas flows radially outward through the turret gas flow chamber.

6. The first turret assembly of claim 5, wherein the plurality of purge gas orifices are defined by at least one of:

a plurality of fins extending downwardly from and integrally formed on an underside of a cover plate secured to the annual turret body; and a plurality of fins extending radially from an arcuate outer peripheral edge of each of the arcuate container pockets toward the corresponding turret gas flow chamber.

7. The first turret assembly of claim 6, wherein at least one of a distance between adjacent fins decreases towards an outer peripheral edge of the arcuate container pocket and a radial length of each fin decreases from a central location of the arcuate container pocket towards an outer peripheral edge of the arcuate container pocket.

8. The first turret assembly of claim 4, wherein the plurality of purge gas orifices are defined by at least one of:

a plurality of fins extending downwardly from and integrally formed on an underside of a cover plate secured to the annual turret body; and a plurality of fins extending radially from an arcuate outer peripheral edge of each of the arcuate container pockets toward the corresponding turret gas flow chamber.

9. The turret assembly of claim 1, further comprising an annular chamber defined in the annular turret body configured to receive the hub, wherein the annular chamber is defined by an inner annular wall located radially inward of the outer periphery of the annular turret body and an annular flange extending radially inward from a lower portion of the inner annular wall, wherein said annular flange includes a plurality of apertures and said hub includes a plurality of apertures alignable with the apertures in said annular flange, and wherein a plurality of fasteners are configured to extend through corresponding substantially aligned apertures in said annular flange and in said hub.

10. A turret system for a container sealing system, comprising:

a first turret assembly; and a second turret assembly, comprising:

a hub adjustably securable to the container sealing system such that a timing of the second turret assembly may be adjusted relative to the first turret assembly;

a first annular turret body having a plurality of arcuate container pockets arrayed about an outer periphery of the first annular turret body, the first annular turret body removably securable to the hub;

a second annular turret body having a plurality of arcuate container pockets arrayed about an outer periphery of the second annular turret body, the second annular turret body removably securable to the hub; and an alignment assembly configured to align the first annular turret body on the hub for use with a first container and configured to align the second annular turret body on the hub for use with a second container, wherein the first turret assembly remains timed relative to the second turret assembly when either of the first and second annular turret bodies is received on the hub.

11. The turret system of claim 10, wherein the hub is secured to the container sealing system such that one of said annular turret bodies can be replaced by another one of said annular turret bodies without removing the hub from the container sealing system.

12. The turret system of claim 11, further comprising an annular chamber defined in the first annular turret body configured to receive the hub, wherein the annular chamber is defined by an inner annular wall located radially inward of the outer periphery of the first annular turret body and an annular flange extending radially inward from a lower portion of the inner annular wall, wherein said annular flange includes a plurality of apertures and said hub includes a plurality of apertures alignable with the apertures in said annular flange, and wherein a plurality of fasteners are configured to extend through corresponding substantially aligned apertures in said annular flange and in said hub.

13. The turret system of claim 10, further comprising, for each of the annular turret bodies, a purge gas assembly configured to direct purge gas across a headspace between a container end and a surface of a product within a container located in one of the plurality of arcuate container pockets in order to purge air from the container immediately prior to sealing, wherein the gas purge assembly is configured to at least one of:

create a laminar flow of purge gas through the hub and the corresponding annular turret body;

direct purge gas upwardly as it flows radially through the hub and the corresponding annular turret body toward an orifice assembly in the arcuate container pocket; and decrease a velocity of purge gas as it exits an orifice assembly in the arcuate container pocket.

14. The turret system of claim 13, wherein the gas purge assembly includes:

a plurality of gas purge inlets defined in the hub that are configured to receive purge gas from a purge gas supply;

a plurality of hub gas flow chambers defined in the hub, each in fluid communication with a corresponding gas purge inlet;

a plurality of turret gas flow chambers defined in the corresponding annual turret body, each in fluid communication with a corresponding hub flow chamber; and a plurality of purge gas orifices defined in each of the arcuate container pockets of the corresponding annular turret body, wherein each of the plurality of purge gas orifices is in fluid communication with a corresponding hub gas flow chamber.

15. The turret assembly of claim 14, wherein a cross-sectional area of each turret gas flow chamber increases as the purge gas flows radially outward through the turret gas flow chamber.

16. The turret assembly of claim 14, wherein the plurality of purge gas orifices are defined by at least one of:

a plurality of fins extending downwardly from and integrally formed on an underside of a cover plate secured to the annual turret body; and a plurality of fins extending radially from an arcuate outer peripheral edge of each of the arcuate container pockets toward the corresponding turret gas flow chamber.

17. A turret system for use with a container sealing system, comprising:

two or more annular turrets, each annular turret comprising:

a plurality of arcuate container pockets arrayed about an outer periphery of the annular turret;

an annular chamber located radially inward of the outer periphery; and a hub removably securable within the annular chamber of each of the two or more annular turrets for selectively mounting each of said annular turrets to the hub;

wherein the hub is adapted to be rotatably secured to the container sealing system and is securable within the annular chamber of each of the two or more annular turrets while the hub is secured to the container sealing system such that one of said annular turrets can be replaced by another one of said annular turrets without removing the hub from the container sealing system.

18. The turret system of claim 17, further comprising an annular chamber defined in each of the annular turrets configured to receive the hub, wherein the annular chamber is defined by an inner annular wall located radially inward of the outer periphery of the annular turret and an annular flange extending radially inward from a lower portion of the inner annular wall, wherein said annular flange includes a plurality of apertures and said hub includes a plurality of apertures alignable with the apertures in said annular flange, and wherein a plurality of fasteners are configured to extend through corresponding substantially aligned apertures in said annular flange and in said hub.

19. The turret system of claim 17, further comprising, for each of the annular turrets, a purge gas assembly configured to direct purge gas across a headspace between a container end and a surface of a product within a container located in one of the plurality of arcuate container pockets in order to purge air from the container immediately prior to sealing, wherein the gas purge assembly is configured to at least one of:

create a laminar flow of purge gas through the hub and the corresponding annular turret;

direct purge gas upwardly as it flows radially through the hub and the corresponding annular turret toward an orifice assembly in the arcuate container pocket; and decrease a velocity of purge gas as it exits an orifice assembly in the arcuate container pocket.

20. The turret system of claim 19, wherein the gas purge assembly includes:

a plurality of gas purge inlets defined in the hub that are configured to receive purge gas from a purge gas supply;

a plurality of hub gas flow chambers defined in the hub, each in fluid communication with a corresponding gas purge inlet;

a plurality of turret gas flow chambers defined in the corresponding annual turret, each in fluid communication with a corresponding hub flow chamber; and a plurality of purge gas orifices defined in each of the arcuate container pockets of the corresponding annular turret, wherein each of the plurality of purge gas orifices is in fluid communication with a corresponding hub gas flow chamber.

* * * * *